US006615920B1

(12) United States Patent
Collins et al.

(10) Patent No.: US 6,615,920 B1
(45) **Date of Patent: *Sep. 9, 2003**

(54) TEMPLATE AND SYSTEM OF TEMPLATES FOR DRILLING AND COMPLETING OFFSET WELL BORES

(75) Inventors: Gary J. Collins, Richmond, TX (US); John Lindley Baugh, Houston, TX (US); Doug J. Murray, Humble, TX (US); Aubrey Clifton Mills, Magnolia, TX (US)

(73) Assignee: Marathon Oil Company, Findlay, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/528,781

(22) Filed: Mar. 17, 2000

(51) Int. Cl.[7] ..... E21B 7/04; E21B 33/13

(52) U.S. Cl. ..... 166/313; 166/50; 166/117.6; 166/289; 175/61

(58) Field of Search ..... 166/313, 289, 166/285, 50, 117.6, 115; 175/61, 80, 81

(56) References Cited

U.S. PATENT DOCUMENTS 3,036,634 A * 5/1962 Corley, Jr. ..... 166/286
4,606,410 A 8/1986 Becker et al.
4,646,839 A * 3/1987 Rickey ..... 166/155
5,322,127 A * 6/1994 McNair et al. ..... 166/117.6
5,330,007 A 7/1994 Collins et al.
5,458,199 A 10/1995 Collins et al.
5,655,602 A 8/1997 Collins
5,685,373 A 11/1997 Collins et al.
5,878,815 A 3/1999 Collins
5,960,873 A * 10/1999 Alexander et al. ..... 166/117.6
5,979,560 A * 11/1999 Nobileau ..... 166/117.6
6,253,852 B1 * 7/2001 Nobileau ..... 166/117.6
6,311,776 B1 * 11/2001 Pringle et al. ..... 166/117.6
6,336,507 B1 * 1/2002 Collins ..... 166/117.5

* cited by examiner

*Primary Examiner*—Hoang Dang
(74) *Attorney, Agent, or Firm*—Jack E. Ebel

(57) ABSTRACT

One or more templates are provided for circulating fluids in a main well bore and for drilling and completing at least one offset well bore from the main well bore. Each template has a body, an inlet leg, a main outlet leg, and an offset outlet leg. A straddle assembly is mounted in the template to configure the template for fluid circulation. The straddle assembly, in cooperation with the inlet and main outlet legs, effects a downhole flow path which directs fluids from the inlet leg through body of the template and out the main outlet leg, bypassing the offset outlet leg. The straddle assembly is distally displaced from the template to reconfigure the template for drilling. A diverter is placed in the body of the template upon displacement of the straddle assembly to define a drill string path from the inlet leg to the offset outlet leg. The offset well bore is drilled by conveying a drill string through the drill string path. The diverter may then be used to direct additional fluids or tools from the inlet leg to the offset outlet leg for completion of the offset well bore.

52 Claims, 16 Drawing Sheets

52
20
22
26
28
25
21
4
4
32
30
27
24
23

54
52
22
20
26
28
25
29
40a
21
44
33
27
31
47
30
32
49
23
24
50

Fig. 17
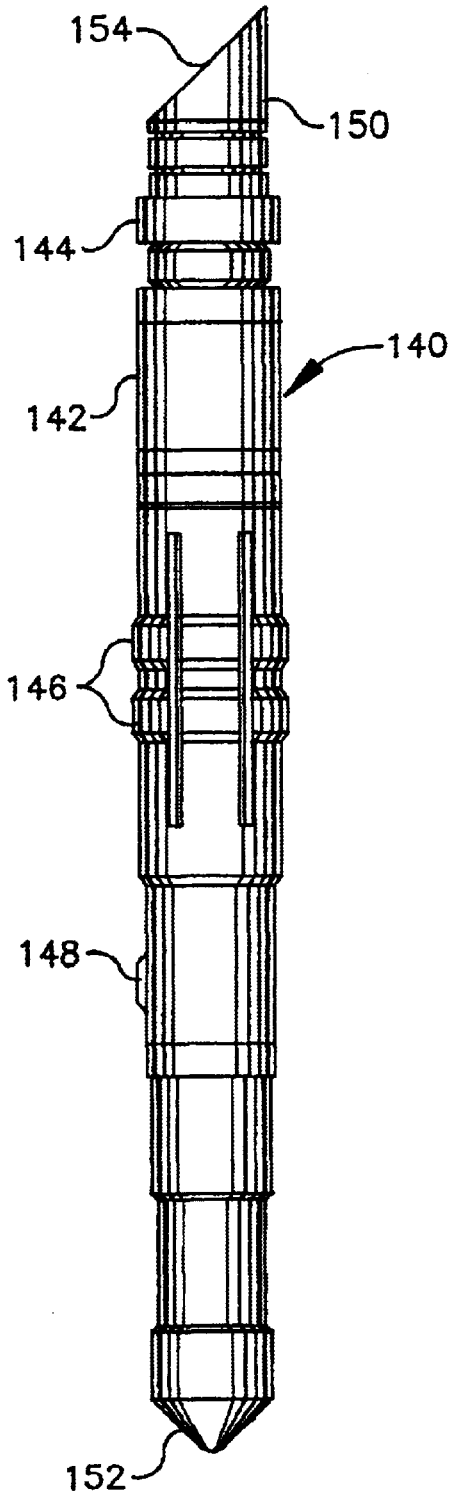
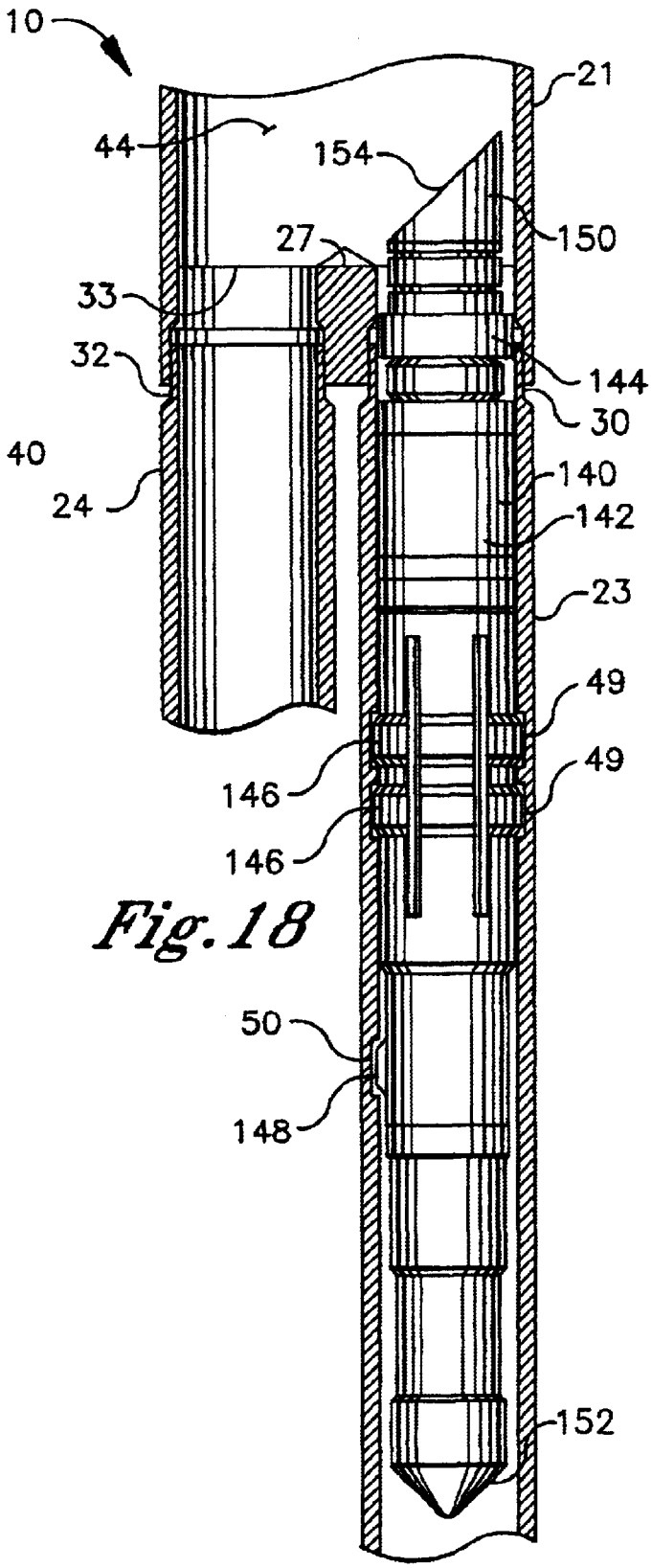
Fig. 18

134
22
20a
44
24
23
92
162
166
133
130
22
20b
44
24
23
94
90
162
164
133
130
98
107
20c
22
24
44
23
162
160
133
130
128
132
120
130
100

TEMPLATE AND SYSTEM OF TEMPLATES FOR DRILLING AND COMPLETING OFFSET WELL BORES

TECHNICAL FIELD

The present invention relates generally to a template positioned in a well bore and, more particularly, to a template or system of templates having a configuration which enables circulation of fluids through the template when placed in a main well bore and having alternate configurations which enable drilling and completion of offset well bores through the template from the main well bore.

BACKGROUND OF THE INVENTION

Well bores are commonly drilled into subterranean formations at an orientation which deviates from true vertical to increase hydrocarbon production from a given well and/or to reduce the unit cost of hydrocarbon recovery from a given well. For example, a deviated well bore penetrating a fractured formation can increase the drainage area defined by the well bore to substantially increase hydrocarbon production from the resulting well. The use of deviated well bores also increases the number of well bores which can be drilled and completed from a single offshore drilling platform having a set number of drilling slots. The ability to recoup the substantial fixed cost of constructing the offshore drilling platform is often enhanced as a function of the number of well bores which can be drilled and completed from the platform. A plurality of deviated or offset well bores can be drilled from any one drilling slot on an offshore drilling platform using current technology as evidenced, for example, by U.S. Pat. No. 5,330,007. A downhole template is employed to guide the drill string in a desired direction which is offset from the surface casing for the purpose of drilling an offset well bore.

The present invention recognizes a need for a downhole template which can be positioned and cemented in a main well bore to enable drilling and completion of an additional offset well bore from the main well bore using the template. One of the problems encountered in developing such a template is to define template configurations and procedures which more easily and cost-effectively enable circulating fluids past the template in the main well bore to cement the template therein and which also relatively easily and cost-effectively enable drilling and completion of an offset well bore using the resulting cemented template. Accordingly, it is an object of the present invention to provide a downhole template or system of downhole templates which is configured for circulating fluids past the templates when placed in a well bore. It is another object of the present invention to provide a process for circulating fluids past the template or system of templates in a main well bore, particularly for the purpose of cementing the templates in the main well bore. It is yet another object of the present invention to provide a template or system of templates which is reconfigured for drilling and completing one or more offset well bores from the main well bore. It is still another object of the present invention to provide a process for reconfiguring the template or system of templates from a fluid circulation configuration to drilling or completion configurations. It is a further object of the present invention to provide processes for drilling and completing one or more offset well bores from the main well bore using the template or system of templates. These objects and others are achieved in accordance with the invention described hereafter.

SUMMARY OF THE INVENTION

The present invention encompasses an individual downhole template, a system of such individual downhole templates, and processes for using the template or system of templates in a well bore. In accordance with one embodiment, the invention is a template positionable in a main well bore and configured for drilling an offset well bore from the main well bore. The template includes a body having a proximal face and a distal face, wherein the body encloses a primary chamber. The template also includes a tubular inlet leg engaging the proximal face and aligned with an inlet opening in the proximal face, a tubular main outlet leg engaging the distal face and aligned with a main outlet opening in the distal face, and a tubular offset outlet leg engaging the distal face and aligned with an offset outlet opening in the distal face. The body is substantially cylindrical and encloses at least one by-pass tube extending from the proximal face to the distal face in fluid isolation from the primary chamber. The inlet leg is free from intersection with the main outlet leg or the offset outlet leg within the primary chamber. The inlet and main outlet legs are coaxially aligned about a substantially vertical main axis, while the offset outlet leg is substantially parallel to the inlet and main outlet legs. The template can also include a diverter positioned in the body to define a drill string path from the inlet leg to the offset outlet leg or to the main outlet leg. The diverter can also be positioned in the main outlet leg to provide a pressure seal in the main outlet leg, enabling pressure stimulation through the offset outlet leg.

In accordance with another embodiment, the invention is a template positionable in a main well bore and configured for circulating fluids through the main well bore. The template includes a body, a tubular inlet leg, a tubular main outlet leg, and a tubular offset outlet leg, wherein the legs open into the body. An offset plug is positioned in the offset outlet leg. The template also includes a straddle assembly including a straddle tube having proximal and distal ends and proximal and distal seals positioned substantially at the proximal and distal ends. The proximal seal is mounted in the inlet leg and the distal seal is mounted in the main outlet leg to provide a continuous straddle assembly flow path through the body which substantially prevents fluid flow from the inlet leg into the offset outlet leg. Accordingly, a continuous downhole flow path is provided through the inlet leg, the straddle assembly, and the main outlet leg. The template is reconfigured from the fluid circulation configuration to the drilling configuration described above simply by removing the straddle assembly from the body, thereby providing the drill string path from the inlet leg to the offset outlet leg or to the main outlet leg.

In accordance with another embodiment, the invention is a template system positioned in a well bore and having a plurality of templates configured for circulating a fluid in the well bore. The system has an initial template and a first additional template, each of which are substantially as described above, including a body, a tubular inlet leg, a tubular main outlet leg, a tubular offset outlet leg, and a straddle assembly. The main outlet leg of the initial template is serially connected to the inlet leg of the first additional template to connect the continuous downhole flow path of the initial template to the continuous downhole flow path of the first additional template. The template system may further include second or more additional templates positioned in series, wherein the main outlet leg of the first additional template is serially connected to the inlet leg of the second additional template and the main outlet leg of the second additional template is serially connected to the inlet leg of the next additional template to interconnect the continuous downhole flow paths of all the templates.

In accordance with another embodiment, the invention is a template system positionable in a main well bore and having a plurality of templates configured for drilling at least one offset well bore through one of the templates from the main well bore. The system has an initial template and a first additional template, each of which are substantially as described above, including a body having a proximal face and a distal face, wherein the body encloses a primary chamber, a tubular inlet leg engaging the proximal face and aligned with an inlet opening in the proximal face, a tubular main outlet leg engaging the distal face and aligned with a main outlet opening in the distal face, and a tubular offset outlet leg engaging the distal face and aligned with an offset outlet opening in the distal face. The main outlet leg of the initial template is serially connected to the inlet leg of the first additional template. The template system may further include second or more additional templates positioned in series, wherein the main outlet leg of the first additional template is serially connected to the inlet leg of the second additional template and the main outlet leg of the second additional template is serially connected to the inlet leg of the next additional template to interconnect the continuous downhole flow paths of all the templates.

In accordance with another embodiment, the invention is a process for circulating a fluid through a template in a main well bore. The process provides a template including body, a tubular inlet leg, a tubular main outlet leg and a tubular offset outlet leg, wherein the legs open into the body. The template is positioned in a main well bore to form an annulus between the template and a face of the main well bore. A straddle assembly is releasably mounted in the template with the proximal seal positioned in the inlet leg and the distal seal positioned in the main outlet leg to provide a continuous straddle assembly flow path through the body. The straddle assembly substantially prevents fluid flow from the inlet leg into the offset outlet leg, such that a continuous downhole flow path is provided through the inlet leg, the straddle assembly, and the main outlet leg which excludes the offset outlet leg. The offset outlet leg is also plugged to prevent fluid communication between the main well bore and the offset outlet leg. A cement is injected in a distal direction into the downhole flow path and displaced proximally into the annulus by distally displacing the straddle assembly behind the cement. At least one by-pass tube is provided through the template which facilitates proximal displacement of the cement past the template. An offset well bore is drilled through the offset outlet leg which is thereafter completed through the offset outlet leg. The main well bore may also be extended by conveying a drill string through the main outlet leg.

In accordance with another embodiment, the invention is a process for circulating a fluid through a plurality of templates in a main well bore. The process provides an initial template and a first additional template, each including a body, a tubular inlet leg, a tubular main outlet leg and a tubular offset outlet leg, wherein the legs open into the body. The initial and first additional templates are serially positioned in a main well bore with the main outlet leg of the initial template connected to the inlet leg of the first additional template. An initial straddle assembly is releasably mounted in the initial template with the proximal seal positioned in the inlet leg and the distal seal positioned in the main outlet leg to provide a continuous straddle assembly flow path through the body and substantially prevent fluid flow from the inlet leg of the initial template into the offset outlet leg of the initial template. A first additional straddle assembly is releasably mounted in the first additional template with the proximal seal positioned in the inlet leg and the distal seal positioned in the main outlet leg to provide a continuous straddle assembly flow path through the body and substantially prevent fluid flow from the inlet leg of the first additional template into the offset outlet leg of the first additional template, such that a continuous downhole flow path is provided through the initial and first additional templates which excludes the offset outlet legs of the initial and first additional templates. The offset outlet legs of the initial and first additional templates are also plugged to prevent fluid communication between the main well bore and the offset outlet legs of the initial and first additional templates.

A distal extension tube is provided extending beyond the main outlet leg of the first additional template. The distal extension tube has a proximal end connected to the main outlet leg of the first additional template and a distal end opening into the main well bore. A cement is injected in a distal direction into the downhole flow path, through the distal extension tube and displaced proximally into an annulus between a face of the main well bore and the templates. Displacement of the cement into the annulus is effected by plugging the initial straddle assembly flow path to substantially prevent pressure communication between a proximal side of the initial straddle assembly and a distal side of the initial straddle assembly. A positive pressure differential is created on the proximal side of the initial straddle assembly to distally displace the initial straddle assembly which in turn displaces the cement. The first additional straddle assembly flow path is then plugged and the positive pressure differential on the proximal side of the initial straddle assembly is used to distally displace the first additional straddle assembly which further displaces the cement. Displacement of the initial straddle assembly also enables fluid communication between the inlet leg of the initial template and the offset outlet leg of the initial template. Similarly, displacement of the first additional straddle assembly enables fluid communication between the inlet leg of the first additional template and the offset outlet leg of the first additional template. The process may also provide second or more additional templates which are serially positioned the initial and first additional templates, wherein the main outlet leg of the first additional template is connected to the inlet leg of the second additional template and the main outlet leg of the second additional template is connected to the inlet leg of the next additional template. Second or more additional straddle assemblies are releasably mounted in the second or more additional templates with the proximal seal positioned in the inlet leg and the distal seal positioned in the main outlet leg to provide a continuous straddle assembly flow path through the body of the second or more additional templates and substantially prevent fluid flow from the inlet leg of the second or more additional templates into the offset outlet leg of the second or more additional templates. The second or more additional straddle assemblies are distally displaced to further displace the cement into the annulus.

A diverter is placed in the body of the initial template to define a drill string path from the inlet leg to the offset outlet leg of the initial template. An offset well bore is drilled from the main well bore by conveying a drill string through the offset outlet leg of the initial template. The offset well bore is also pressure stimulated through the offset outlet leg of the initial template. A diverter is similarly placed in the body of the first additional template to define a drill string path from the inlet leg to the offset outlet leg of the first additional template. An offset well bore is then drilled from the main well bore by conveying a drill string through the offset outlet leg of the first additional template. The offset well bore is also pressure stimulated through the offset outlet leg of the first additional template.

In accordance with another embodiment, the invention is a process for pressure stimulating a well bore through a template. The process provides a template having a tubular inlet leg, a tubular main outlet leg and a tubular offset outlet leg. The inlet leg and the main outlet leg are positioned in a main well bore and the offset outlet leg is positioned in an offset well bore extending from the main well bore. The main outlet leg is pressure sealed to withstand a pressure of at least about 3500 psi and the offset well bore is pressure stimulated through the offset outlet leg.

The invention will be further understood from the accompanying drawings and description.

BRIEF DESCRIPTION OF THE DRAWINGS

FIG. 17 is a perspective view of a diverter having utility in the present invention.

FIG. 18 is a lengthwise sectional view of the template of FIGS. 1A and 1B having the diverter of FIG. 17 mounted therein for practicing the offset well bore drilling and completion processes of the present invention.

DESCRIPTION OF PREFERRED EMBODIMENTS

Figure 1A:
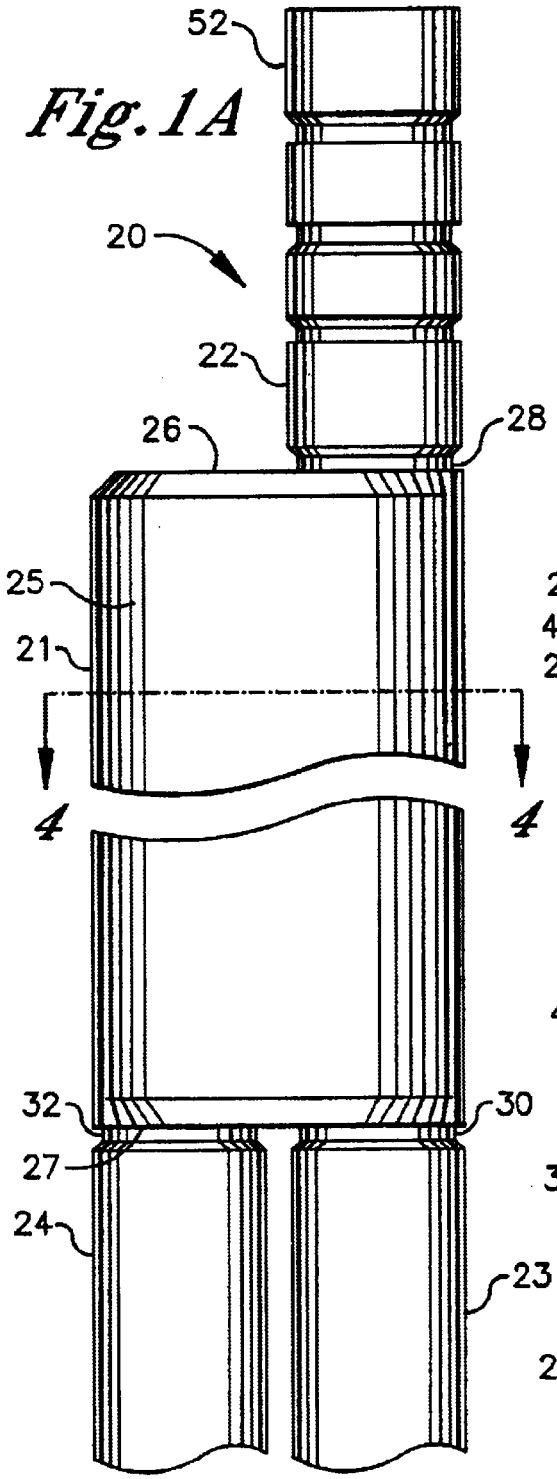
FIGS. 1A and 1B are a perspective view of a template having utility in the present invention.
Figure 5A:
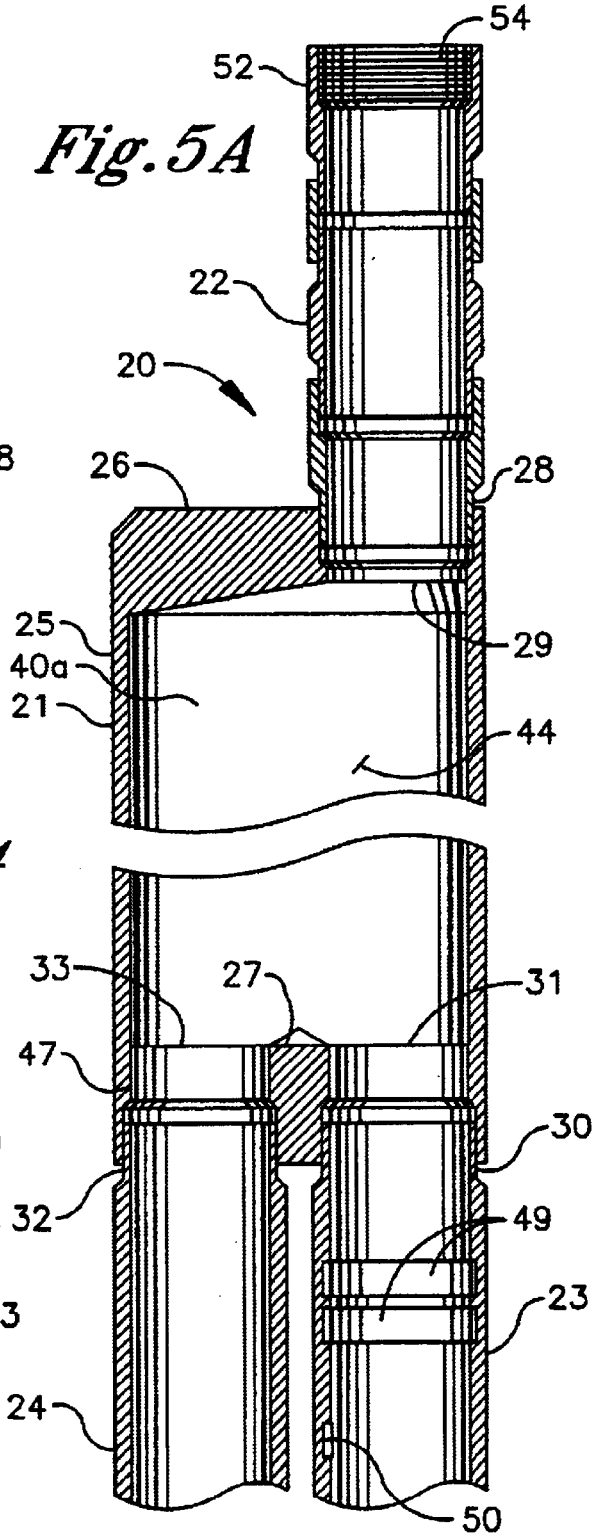
FIGS. 5A and 5B are a lengthwise sectional view of the template of FIGS. 1A and 1B.
Figure 1B:
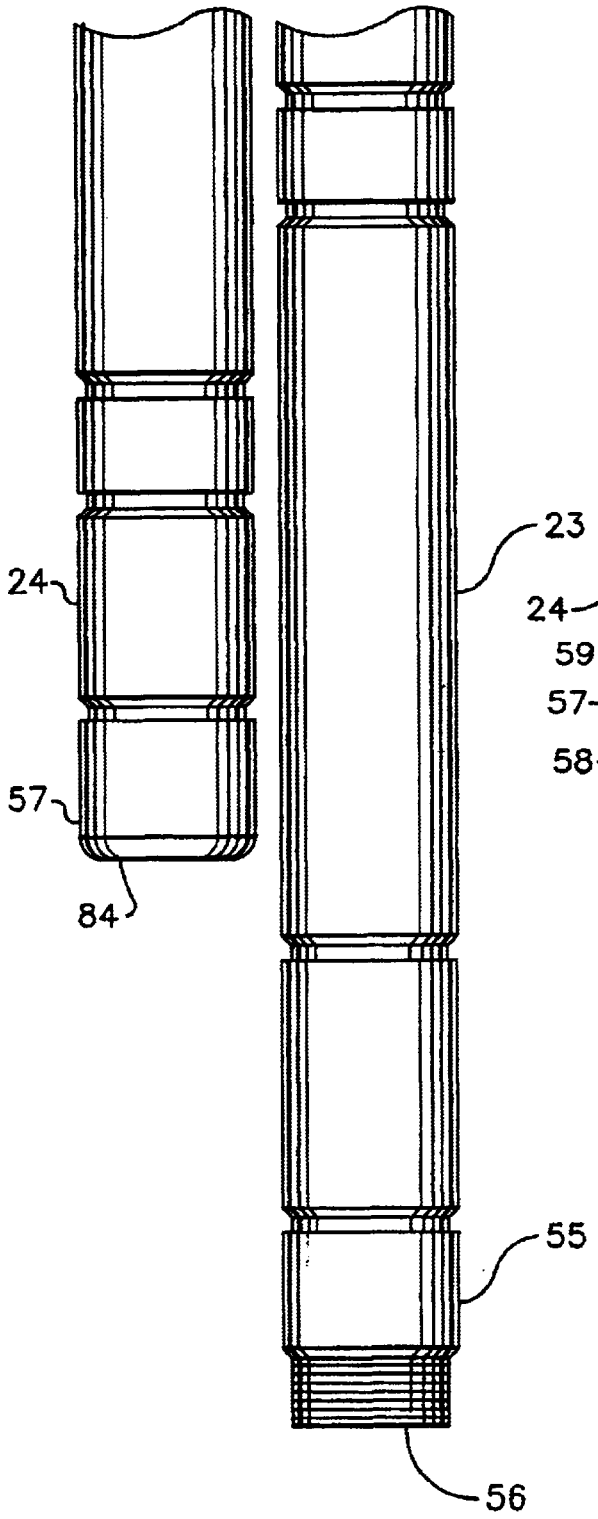
Figure 5B:
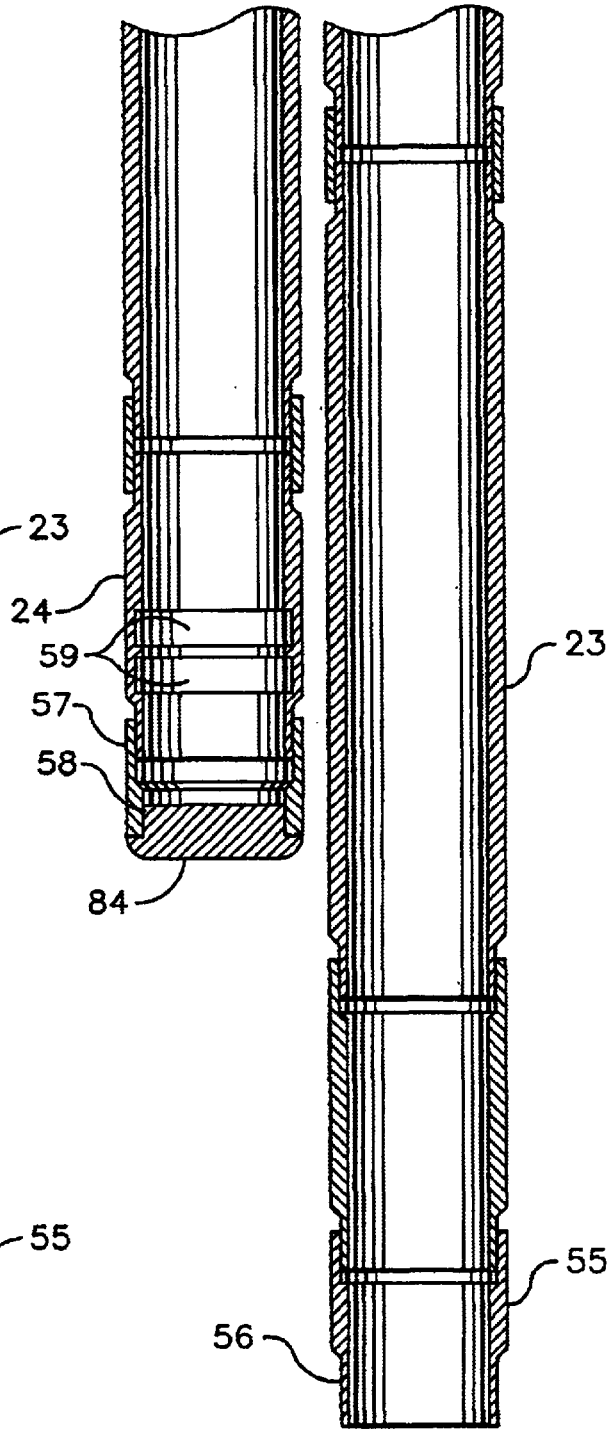

Referring to FIGS. 1A and 1B, a template of the present invention is shown and generally designated 20. The template 20 functions as a guide which has utility in fluid circulation, drilling and completion processes further encompassed by the present invention. The template 20 has a body 21 with a cylindrical configuration which has a plurality of substantially straight tubular members 22, 23, 24 extending from the body 21. Tubular member 22 is an inlet leg, tubular member 23 is a main outlet leg, and tubular member 24 is an offset outlet leg. The body 21 has a cylindrical sidewall 25 and circular proximal and distal plates 26, 27 fitted across the proximal and distal ends of the sidewall 25, respectively. The relative terms "proximal" and "distal" are used herein with reference to a well head, wherein the distal element is generally further downhole from the well head than the corresponding proximal element. The proximal and distal plates 26, 27 are oriented at a right angle to the sidewall 25 and are affixed to the sidewall 25 by means such as welding. The intersecting edges of the sidewall 25 and circular plates 26, 27 are preferably beveled to facilitate distal displacement of the template 20 into a well bore as described hereafter. The proximal and distal plates 26, 27 are solid having a substantial thickness on the order of about 4 to 6 inches.

The inlet leg 22 has a distal end 28 engaging the proximal plate 26 and aligned with an inlet opening 29 in the proximal plate 26. The inlet leg 22 terminates at the proximal plate 26 with the distal end 28 being fixably attached to the proximal plate 26 by screw threads (not shown). The main outlet leg 23 has a proximal end 30 engaging the distal plate 27 and aligned with a main outlet opening 31 in the distal plate 27. The main outlet leg 23 terminates at the distal plate 27 with the proximal end 30 being fixably attached to the distal plate 27 by screw threads (not shown). The inlet leg 22, inlet opening 29, main outlet leg 23 and main outlet opening 31 have substantially identically dimensioned circular cross sections and are coaxially aligned about the same vertical axis of the template 20, termed the main axis. The offset outlet leg 24 is parallel to the inlet and main outlet legs 22, 23, being aligned about a vertical axis, termed the offset axis of the template 20, which is offset from the main axis. The offset outlet leg 24 has a proximal end 32 engaging the distal plate 27 and aligned with an offset outlet opening 33 in the distal plate 27. The offset outlet leg 24 terminates at the distal plate 27 with the proximal end 32 fixably attached to the distal plate 27 by screw threads (not shown). The offset outlet leg 24 and offset outlet opening 33 have substantially identically dimensioned circular cross sections which are substantially identical to those of the inlet leg 22, inlet opening 29, main outlet leg 23 and main outlet opening 31. The openings 29, 31, 33 all have beveled edges to facilitate passage therethrough.

Figure 2:
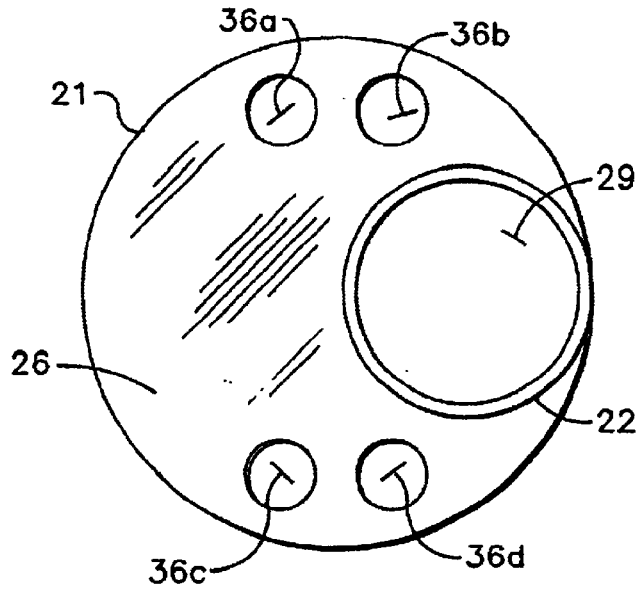
FIG. 2 is of the template of FIGS. 1A and 1B.
Figure 3:
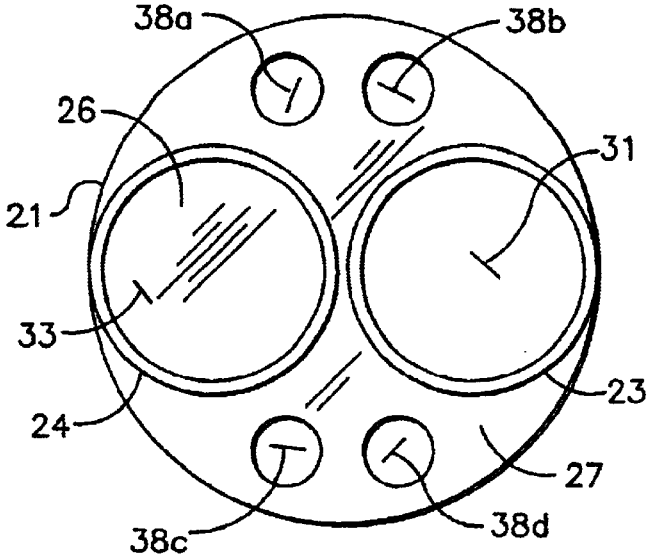
FIG. 3 is a bottom view of the template of FIGS. 1A and 1B.
Figure 4:
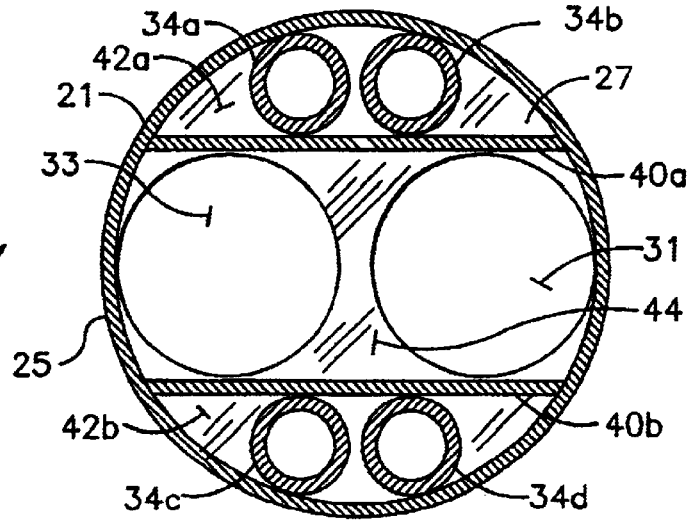
FIG. 4 is a cross sectional view of the template of FIGS. 1A and 1B taken along line 4—4.

Referring additionally to FIGS. 2–4, a plurality of by-pass tubes 34*a*, 34*b*, 34*c*, 34*d* are retained within the body 21. Each by-pass tube, generally designated 34, extends through the body 21 from the proximal plate 26 to the distal plate 27 in a parallel orientation with the inlet leg 21, main outlet leg 22, and offset outlet leg 23. The by-pass tubes 34*a*, 34*b*, 34*c*, 34*d* are continuously open throughout their entire length and are aligned with proximal by-pass openings 36*a*, 36*b*, 36*c*, 36*d* and distal by-pass openings 38*a*, 38*b*, 38*c*, 38*d* in the proximal and distal plates 26, 27, respectively. Retention plates 40*a*, 40*b* extend vertically through the body 21 along the length of the by-pass tubes 34 and are sealingly affixed to the side wall 25 and proximal and distal plates 26, 27. The retention plates define a plurality of chambers 42*a*, 42*b*, 44 within the body 21 which are in fluid isolation from one another. The chamber 42*a* is a by-pass chamber which retains the by-pass tubes 34*a*, 34*b*. The chamber 42*b* is similarly a by-pass chamber which retains the by-pass tubes 34*c*, 34*d*. The chamber 44 is a primary chamber which is positioned between and is substantially larger than the by-pass chambers 42*a*, 42*b*. The entire volume of the primary chamber 44 is substantially open, having a substantially uniform continuous cross section devoid of any obstructions. Accordingly, the legs 22, 23, 24 do not substantially extend into the primary chamber 44 and are free from intersection with one another within the primary chamber 44.

The inlet leg 22, inlet opening 29, primary chamber 44, main outlet opening 31 and main outlet leg 23 define a first (or main) guide path through the template 20, while the inlet leg 22, inlet opening 29, primary chamber 44, offset outlet opening 33 and offset outlet leg 24 define a second (or offset) guide path through the template 20. The main and offset guide paths may be characterized in combination as approximating an "h" configuration. The main guide path is continuous and linear along its entire length through the template 20. The offset guide path proceeds linearly through the inlet leg 22, but deviates from its linear path in the primary chamber 44 toward the offset outlet leg 24. Upon exiting the primary chamber 44, the offset guide path proceeds linearly through the offset outlet leg 24. Accordingly, the offset guide path in its entirety has a continuous, but non-linear, route through the template 20. It is noted that the inlet leg 22, main outlet leg 23, and offset outlet leg 24 are all parallely aligned with the longitudinal axis of a well bore when the template 20 is operationally positioned in a well bore as described hereafter. It is further noted that the main outlet leg 23 is substantially longer than the offset outlet leg 24, while the inlet leg 22 is substantially shorter than either.

The template 20 is provided with a plurality of coupling elements which enable coupling of the template 20 with additional downhole components utilized in the systems and processes of the present invention. For example, a pair of circular grooves 49 and a longitudinal slot 50 are formed in the inside face of the main outlet leg 23 which facilitate placement of a diverter in the template 20 in a manner described hereafter. The proximal end 52 of the inlet leg 22 is provided with internal screw threads 54 while the distal end 55 of the main outlet leg 23 is provided with external screw threads 56. The screw threads 54, 56 enable coupling of the distal end 55 of the main outlet leg 22 of one template 20 to the proximal end 52 of the inlet leg 22 of another like template 20, to an alternately configured template, to a connective tubing string, or to another downhole connective component as will be described hereafter. Similarly, the distal end 57 of the offset outlet leg 24 is provided with internal screw threads 58 which enable coupling of the distal end 57 of the offset outlet leg 24 to other downhole components as needed. A pair of circular grooves 59 are formed in the inside face of the offset outlet leg 24 which facilitate placement of a hanger assembly in the template 20 in a manner described hereafter. The screw threads 54, 56, 58 are shown herein by way of example. It is apparent to the skilled artisan that the internality or externality of the screw threads 54, 56, 58 can be reversed or that other conventional coupling means not shown can be used for joining the templates 20 to one another or to other downhole components within the scope of the present invention.

The template 20 may have a one-piece unitary construction or may be constructed from multiple sections which are secured together by any suitable means, such as screw threads, cam locks, welds, or the like, and sealed at their joints by any suitable means, such as O-rings or other gaskets. The template 20 is preferably constructed from a suitable metal or combination of metals, which is chosen based on the loads and pressures to be encountered in the well bore during use. Generally the entire template 20 has a length of about 20 to about 30 feet or more. The body 21 typically has a length of at least about 12 feet to accommodate a relatively gradual arcuate deviation of the offset guide path. The body 21 typically has an outside diameter on the order of about 0.3 meters to fit within a conventional well bore. The cylindrical configuration of the body 21 enables the template 20 to substantially resist displacement from a well bore when the template 20 is cemented in a well bore in a manner described hereafter. The template 20 resists displacement in a well bore at pressures of at least 3,500 psi, preferably at least 7,000 psi, and more preferably at least 10,000 psi or more, which is substantially greater than would be possible for known templates having a non-cylindrical body.

Figure 6:
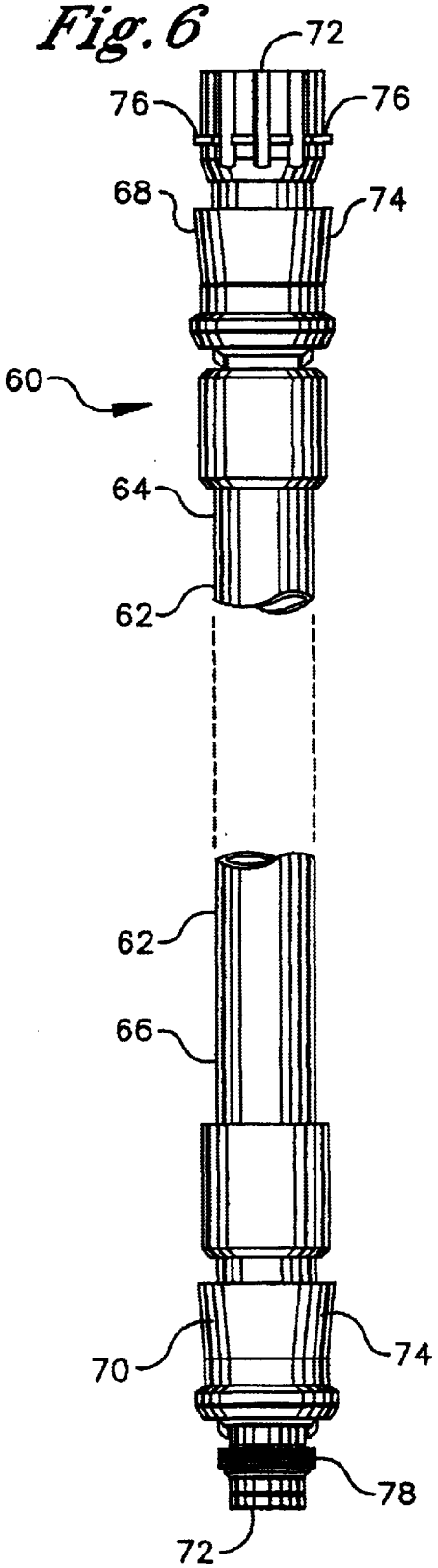
FIG. 6 is a perspective view of a straddle assembly having utility in the present invention.

Referring to FIG. 6, a straddle assembly having cooperative utility as an additive component of the template 20 is shown and generally designated 60. The straddle assembly 60 includes a continuous length of a straddle tube 62 having an open proximal end 64 and an open distal end 66. The straddle tube 62 is formed from a strong rigid material, such as fiberglass or aluminum, which can be readily drilled through with a conventional oil field drill bit. The straddle assembly 60 further includes a proximal seal 68 and a distal seal 70, conventionally termed wiper plugs, which are coupled with the open proximal and distal ends 64, 66 of the straddle tube 62, respectively, by screw threads. The proximal and distal seals 68, 70 have central apertures 72 which are aligned with the open straddle tube 62 to define a continuous straddle assembly flow path. The length of the straddle assembly 60 is substantially greater than the length of the body 21.

The proximal seal 68 comprises a frusticonically-shaped gasket 74 which is tapered in a distal direction to facilitate distal displacement of the straddle assembly 60 into and through the template 20. The proximal seal 68 further comprises a plurality of radially extending retention pins 76 which function in a manner described hereafter. The central aperture 72 of the proximal seal 68 is provided with internal screw threads (not shown). The distal seal 70 has a substantially similar construction as the proximal seal 68, likewise comprising a gasket 74, but lacking the retention pins 76. The distal seal 70 is provided with external threads 78 which are receivable by the corresponding internal screw threads provided in the central aperture 72 of the proximal seal 68 enabling end to end coupling of multiple straddle assemblies 60 to one another in series.

Figure 7:
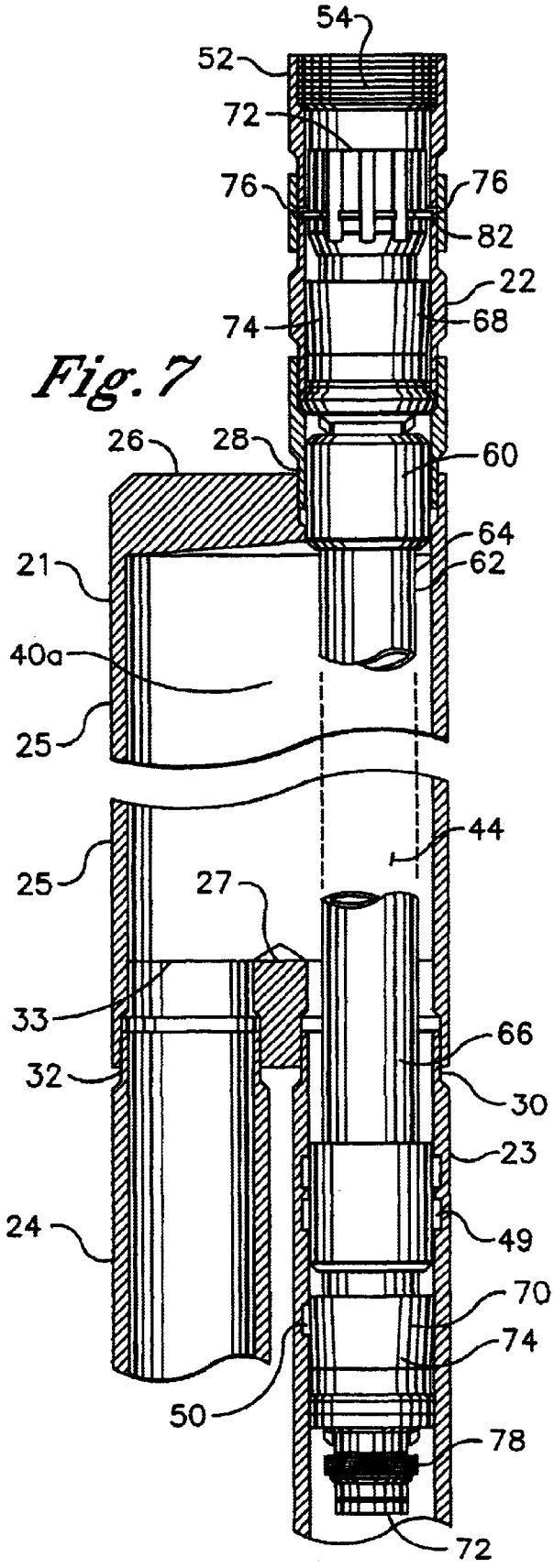
FIG. 7 is a lengthwise sectional view of the template of FIGS. 1A and 1B having the straddle assembly of FIG. 6 mounted therein for practicing a fluid circulation process of the present invention.
Figure 8:
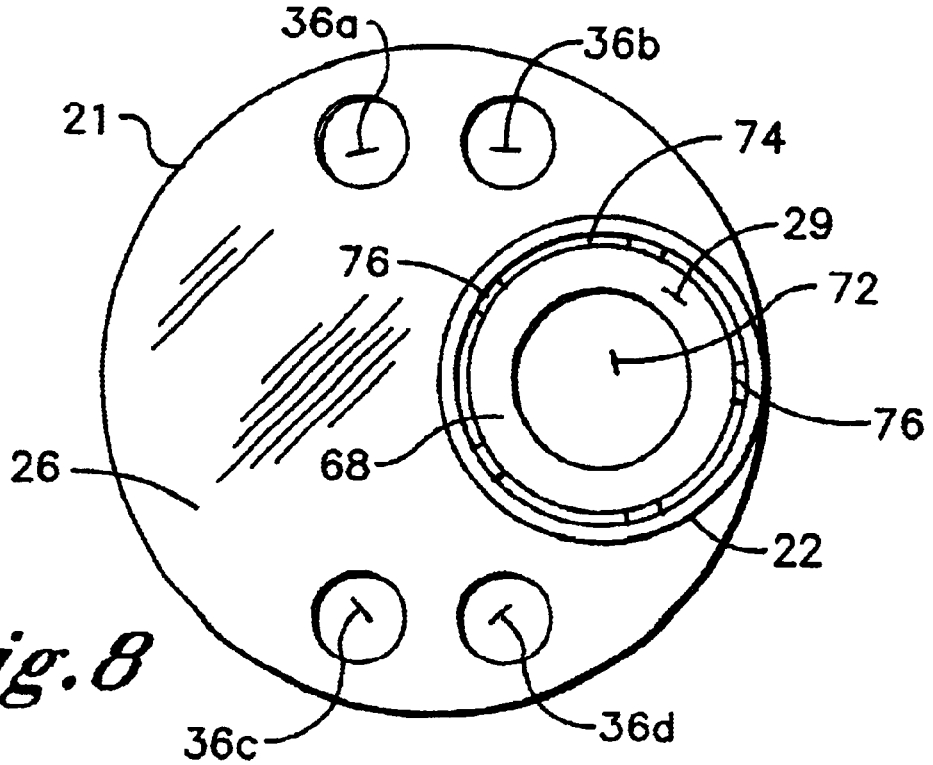
FIG. 8 is a top view of the template and straddle assembly of FIG. 7.
Figure 9:
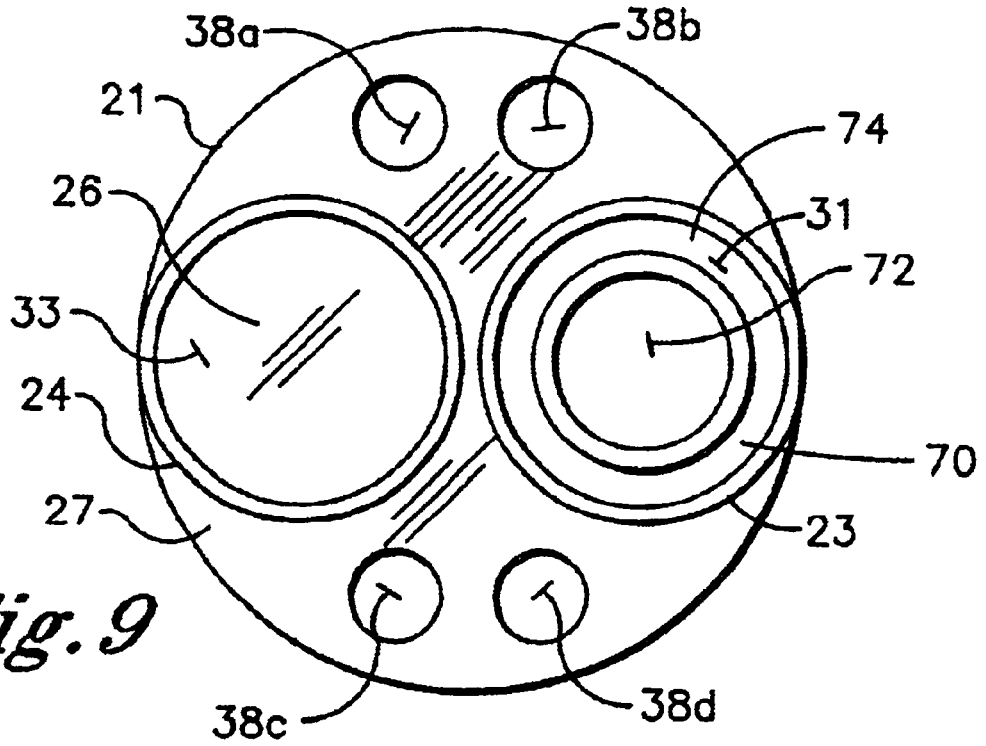
FIG. 9 is a bottom view of the template and straddle assembly of FIG. 7.

Referring to FIGS. 7–9, the straddle assembly 60 is shown releasably mounted in the template 20 in accordance with the fluid circulation process of the present invention. The straddle tube 62 is positioned in the primary chamber 44 while the proximal seal 68 is positioned in the inlet leg 22 and the distal seal 70 is positioned in the main outlet leg 23. Releasable mounting of the straddle assembly 60 in the template 20 is effected by engaging the retention pins 76 with an internal shoulder 82 in the proximal end 52 of the inlet leg 22. When the retention pins 76 of the proximal seal 68 engage the shoulder 82, the proximal and seals 68, 70 are positioned as desired in the inlet and main outlet legs 22, 23, respectively, while the retention pins 76 prevent further distal movement of the straddle assembly 60 within the template 20 under normal operating pressures of the present fluid circulation process. The retention pins 76 have a predetermined pressure failure threshold which renders them shearable at an elevated pressure enabling the practitioner to release the straddle assembly 60 from its mount within the inlet and main outlet legs 22, 23 in a manner described hereafter.

The proximal and distal seals 68, 70 are each sized to have an outside diameter which approximates the inside diameter of the inlet and main outlet legs 22, 23 to form a fluid-tight seal between the inside faces of the inlet and main outlet legs 22, 23 and the gaskets 74 of the seals 68, 70. Accordingly, the inlet leg 22, straddle assembly 60, and main outlet leg 23 define a continuous downhole flow path through the template 20. The straddle assembly 60 fluid isolates the downhole flow path from the offset outlet leg 24. A fluid-tight offset plug 84 is screwed into the distal end 57 of the offset outlet leg 24 to fluid isolate the offset outlet leg 24 from the exterior of the template 20 during the fluid circulation.process. The offset plug 84 is formed from a material which can be readily drilled through with a conventional oil field drill bit.

The fluid circulation process of the present invention is described below with initial reference to FIG. 10. A template system, to which the fluid circulation process applies, is shown and generally designated 90. The template system 90 comprises a plurality of templates 20*a*, 20*b*, 20*c*, which are identical to the template 20 described above with reference to FIGS. 1A and 1B. Separate straddle assemblies 60*a*, 60*b*, 60*c* are mounted in each template 20*a*, 20*b*, 20*c*, respectively, as described above with reference to FIGS. 7–9. The straddle assemblies 60*b*, 60*c*, termed the lower straddle assemblies, are identical to the straddle assembly 60 described above with reference to FIG. 6. The straddle assembly 60*a*, termed the top straddle assembly, differs from the lower straddle assemblies 60*b*, 60*c* only in the configuration of the central aperture 72 of the proximal seal 68, which is modified in a manner apparent to the skilled artisan to receive a pump down plug as described hereafter. In all other respects, the top straddle assembly 60*a* is identical to the lower straddle assemblies 60*b*, 60*c*.

The templates 20*a*, 20*b*, 20*c*, having the straddle assemblies 60*a*, 60*b*, 60*c* mounted therein, are shown stacked end to end in series and coupled to one another for purposes of illustration. In particular, the distal end 55 of the main outlet leg 23 of the initial template 20*a*, alternately termed the proximal template, is coupled with the proximal end 52 of the inlet leg 22 of the next distally succeeding template 20*b*, alternately termed the first additional template, by means of the screw threads 56, 54, respectively, to couple the templates 20*a*, 20*b* together. Similarly, the distal end 55 of the first additional template 20*b* is coupled with the proximal end 52 of the next distally succeeding template 20*c*, termed the second additional template, by the screw threads 56, 54, respectively, to couple the templates 20*b*, 20*c* together. It is apparent to the skilled artisan that the successive templates need not be serially stacked end to end within the scope of the present invention. In practice, the successive templates are often serially connected while positioned substantial distances apart from one another up to one thousand feet or more. Where two successive templates are serially connected, yet spaced a distance apart, the distal end 55 of the most proximal template is fluid communicatively connected to the proximal end 52 of the next successive template by means of a conventional connective tubing string (not shown) having substantially the same diameter as the legs 22, 23, 24. For example, the legs 22, 23, 24 and connective tubing string may have a diameter of 5½ inches.

The present template system 90 is shown having a total of three templates, i.e., a proximal template 20*a* and two additional templates 20*b*, 20*c*. It is apparent to the skilled artisan that the template system 90 of the present invention may have as many additional templates as are permitted by the given downhole environment and are desired by the practitioner. Additional templates beyond those shown are successively provided in series from the second additional template 20*c* in substantially the same manner as described above with respect to the preceding templates 20*a*, 20*b*, 20*c*.

The template system 90 is positioned in a main well bore 92 which extends through earthen material from a well head 96 into a formation 94. The main well bore 92 has a resident portion 98, wherein the templates 20*a*, 20*b*, 20*c* reside, which is substantially vertical. The main well bore 92 has a distal portion 100 extending distally beyond the resident portion 98 which is horizontally deviated from the vertical. It is alternatively within the scope of the present invention to provide a main well bore 92 wherein the resident portion 98 deviates somewhat from the vertical or wherein the distal portion 100 is substantially vertical. A surface or intermediate casing 102 is positioned in a proximal portion 104 of the main well bore 92 which extends from the well head 96 to the proximal end 106 of the resident portion 98. The casing 102 may be secured in the proximal portion 104 by cement (not shown) prior to initiating the present fluid circulation process. However, the resident portion 98 is typically an uncased open bore hole having an open annulus 107 between the formation 94 and the templates 20*a*, 20*b*, 20*c*. The distal portion 100 is likewise typically an uncased open bore hole.

The template system 90 further comprises a riser 108 having a distal end 110 which is coupled with the proximal end 52 of the inlet leg 22 of the proximal template 20*a* by the screw threads 54 and corresponding screw threads (not shown) on the distal end 110. The riser 108 has substantially the same inside and outside diameters as the inlet leg 22 of the proximal template 20*a*. The riser 108 extends from the proximal end 106 of the resident portion 98 to a point in the proximal portion 104 where an opposite proximal end 112 of the riser 108 intersects a collar 114. The intersection point is typically positioned relatively near the well head 96. The collar 114 has substantially the same outside diameter as the inside diameter of the casing 102 and has a central opening 116 which is sized to receive the proximal end 112 of the riser 108. The proximal end 112 is coupled with the collar 114 at the central opening 116 by screw threads or other conventional coupling means (not shown).

The inlet leg 22 is off-center relative to the central axis of the main well bore 92 due to the configuration of the proximal template 20*a* while the central opening 116 of the collar 114 is concentric with the central axis of the main well bore 92. As a result, the riser 108 experiences a slight bend in the proximal portion 104 of the main well bore 92 to align with the inlet leg 22 of the proximal template 20*a*. A second collar (not shown) may be positioned at the proximal end 106 of the resident portion 98 to facilitate alignment of the distal end 110 of the riser 108 with the inlet leg 22 of the proximal template 20*a*.

The template system 90 further comprises a distal extension tube 120 having a proximal end 122 and a distal end 124. The proximal end 122 of the distal extension tube 120 is coupled with the distal end 55 of the main outlet leg 23 of the second additional template 20*c* by the screw threads 56 and corresponding screw threads (not shown) on the proximal end 122. The distal extension tube 120 distally extends from the distal end 126 of the resident portion 98 through the distal portion 100 of the main well bore 92, terminating at the distal end 124 of the distal extension tube 120, which is typically at the bottom 128 of the main well bore 92. The distal extension tube 120 has substantially the same inside and outside diameters as the main outlet leg 23 of the second additional template 20*c*, such that the annulus 107 extends beyond the resident portion 98 of the main well bore 92 through the distal portion 100 to the distal end 124. A conventional set shoe 130 and landing collar 132 are serially positioned at the distal end 124. The set shoe 130 has a plurality of lateral ports 133 which provide fluid communication between the interior of the distal extension tube 120 and the annulus 107.

Figure 10:
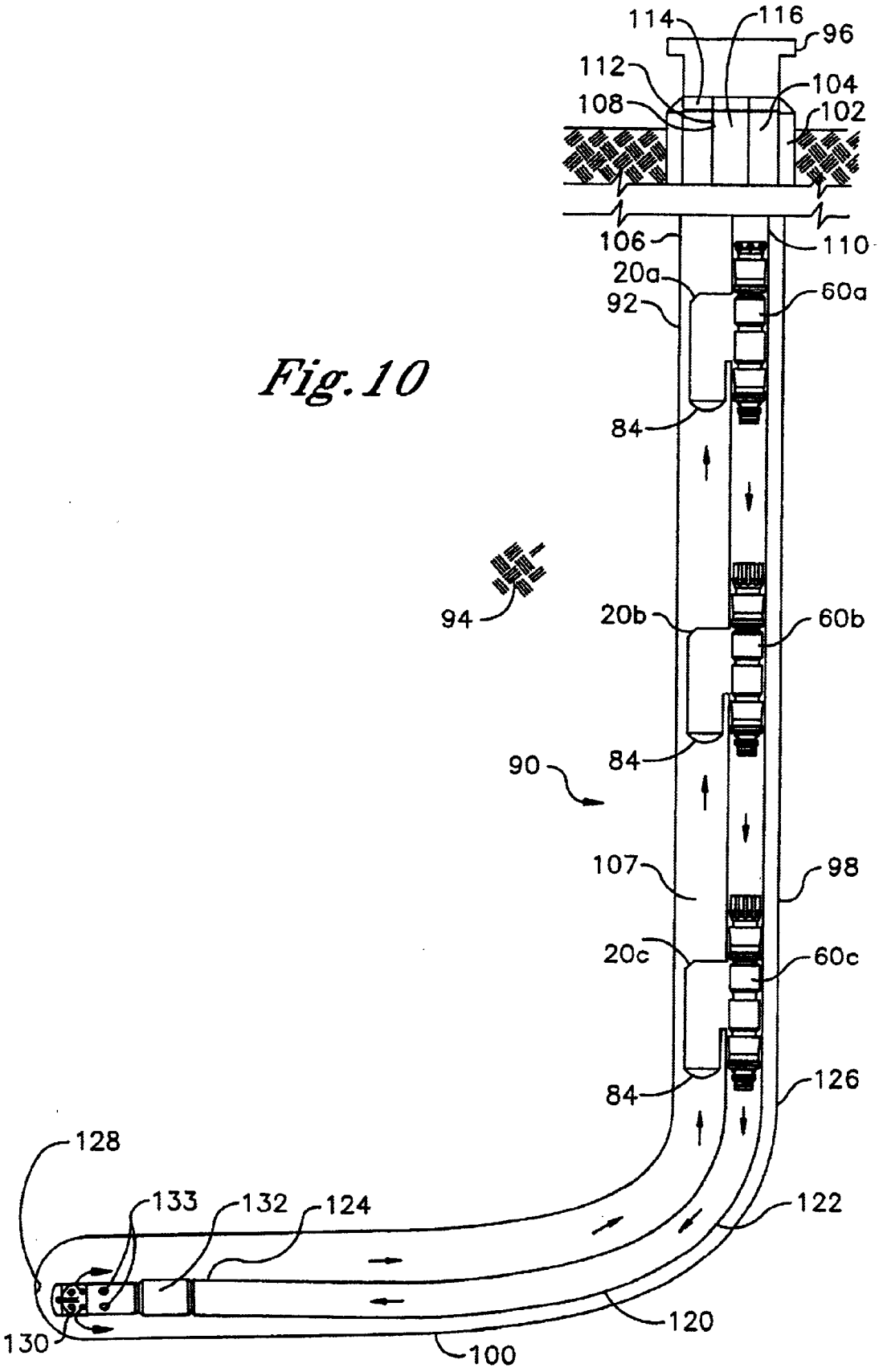
FIG. 10 is a schematic sectional view of a template system of the present invention positioned in a main well bore, wherein the template system is in an operating configuration for practicing the fluid circulation process.

The template system 90, as shown in FIG. 10, is in an operating configuration for the fluid circulation process. As such, the components of the template system 90 are aligned in a manner which renders the downhole flow path continuously open from the central opening 116 to the lateral ports 133. Direct fluid communication is enabled between the well head 96 and the annulus 107 via the downhole flow path, while the offset legs 24 of the templates 20*a*, 20*b*, 20*c* are desirably maintained in substantial fluid isolation from the well head 96 and the annulus 107. The fluid circulation process is initiated by pumping an oil field fluid such as a mud or spacer from the well head 96 through the downhole flow path as shown by the directional arrows. Pumping of the fluid continues with the fluid passing through the distal extension tube 120, out the ports 133 and up the annulus 107. Conventional recirculation means (not shown) may be provided at the collar 114 to enable recirculation of the fluid back into the downhole flow path, if desired. Throughout the fluid circulation process, the straddle assemblies 60*a*, 60*b*, 60*c* and plugs 84 substantially prevent any fluid from entering the offset legs 24 of the templates 20*a*, 20*b*, 20*c*. At the same time, the by-pass tubes 34 enable the circulating fluid to flow upward through the annulus 107 past the templates 20*a*, 20*b*, 20*c* without substantial restriction even where the outside diameter of the cylindrical body 21 is only slightly less than the well bore 92. For example, the body 21 may have a typical outside diameter of 11⅜ inches while the well bore 92 has a diameter of 12¼ inches.

The present fluid circulation operating configuration may be adapted to a series of cementing configurations shown in FIGS. 11–15 which enable one to practice a process for cementing the templates 20*a*, 20*b*, 20*c* into the well bore 92. The cementing process is initiated by pumping a slug 134 of an oil field cement from the well head 96 into the downhole flow path. Pumping of the cement continues until a slug 134 having a desired volume is pumped into the downhole flow path. The cement slug 134 preferably has a volume sufficient to secure the templates 20*a*, 20*b*, 20*c* in the main well bore 92 and seal the annulus 107 to fluid flow when fully displaced into the annulus 107.

Figure 11:
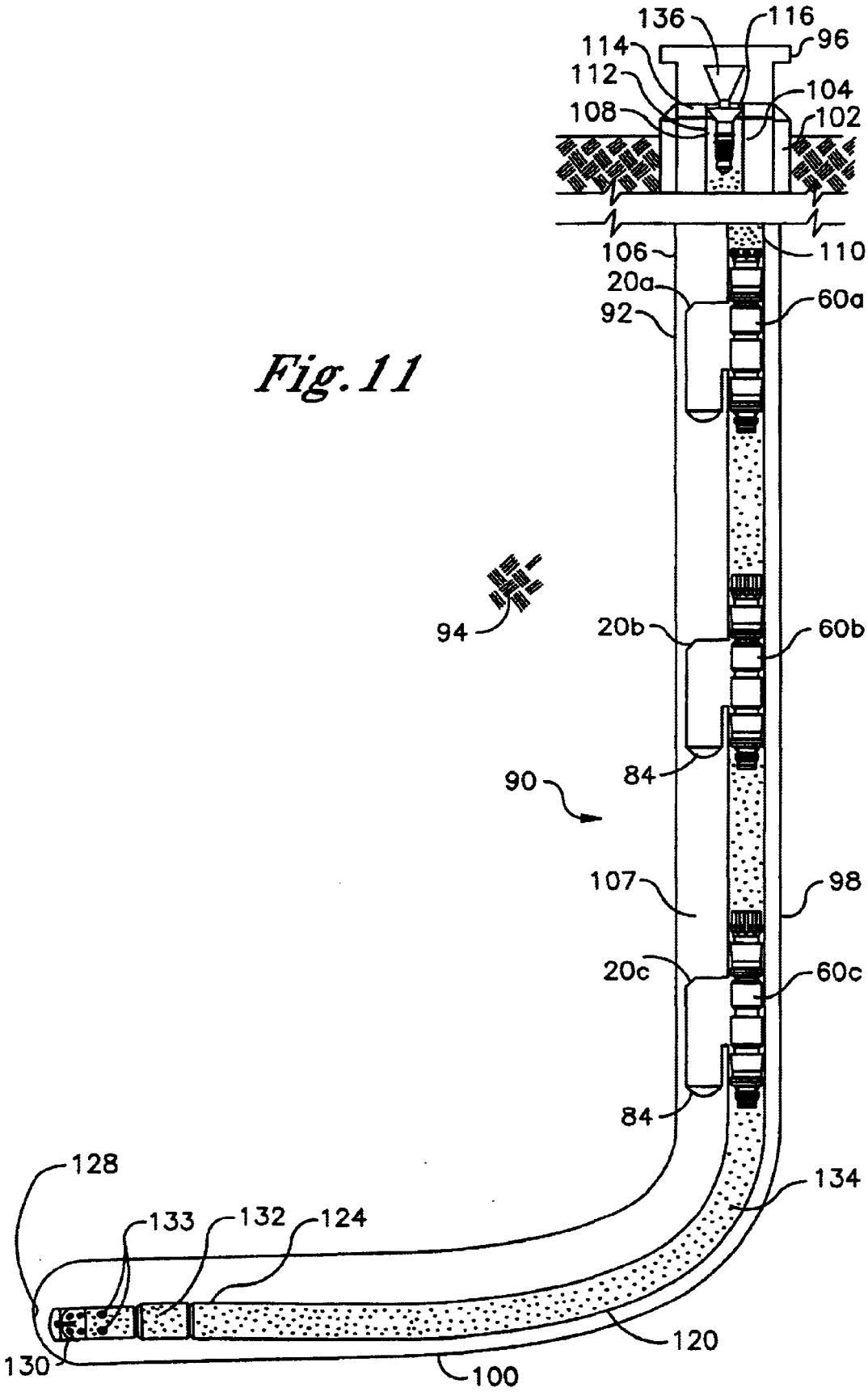
FIGS. 11–15 are a sequence of schematic sectional views of the template system of FIG. 10, wherein the template system is in a sequence of operating configurations for practicing a cementing process in accordance with the present invention.
Figure 12:
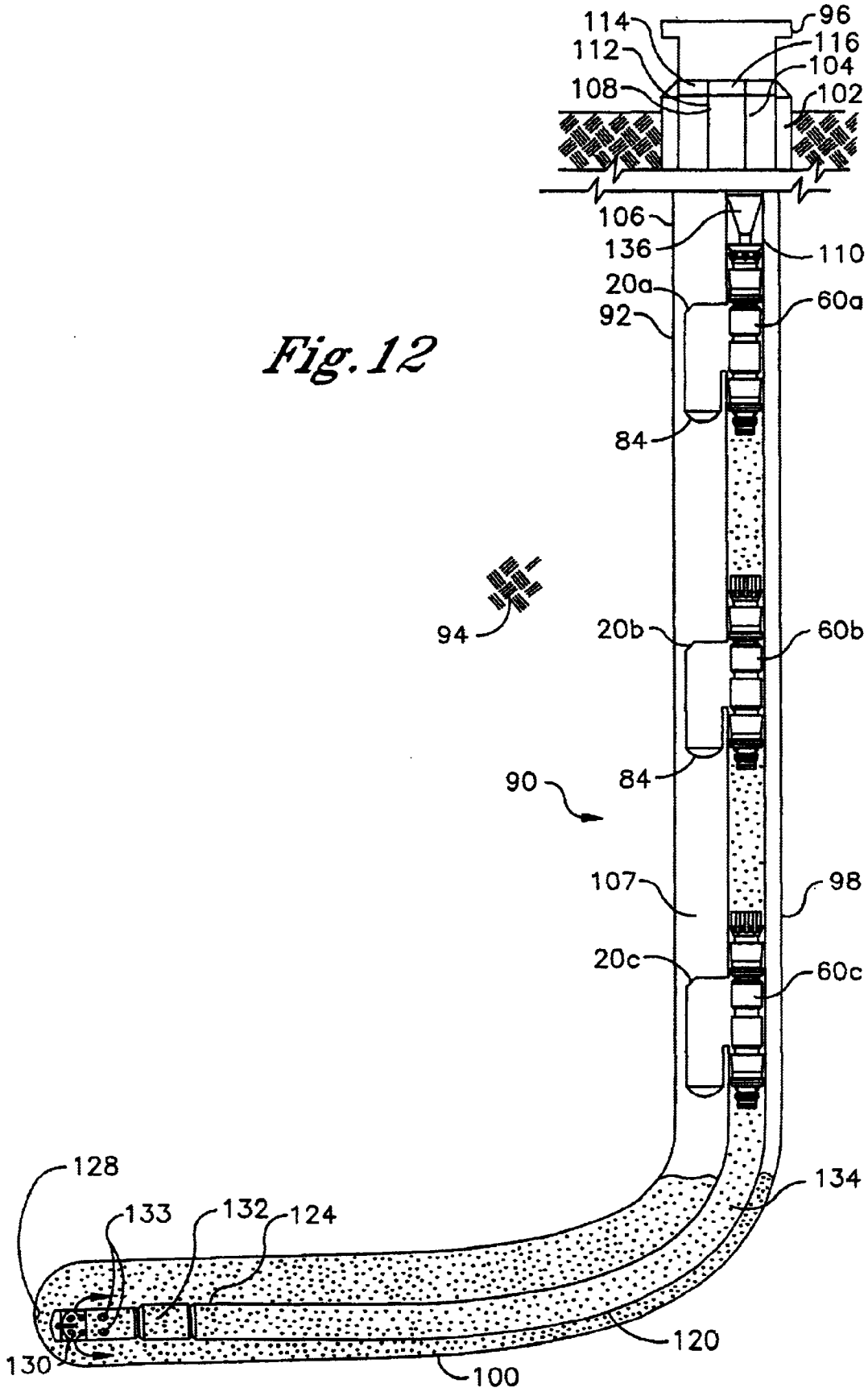
Figure 13:
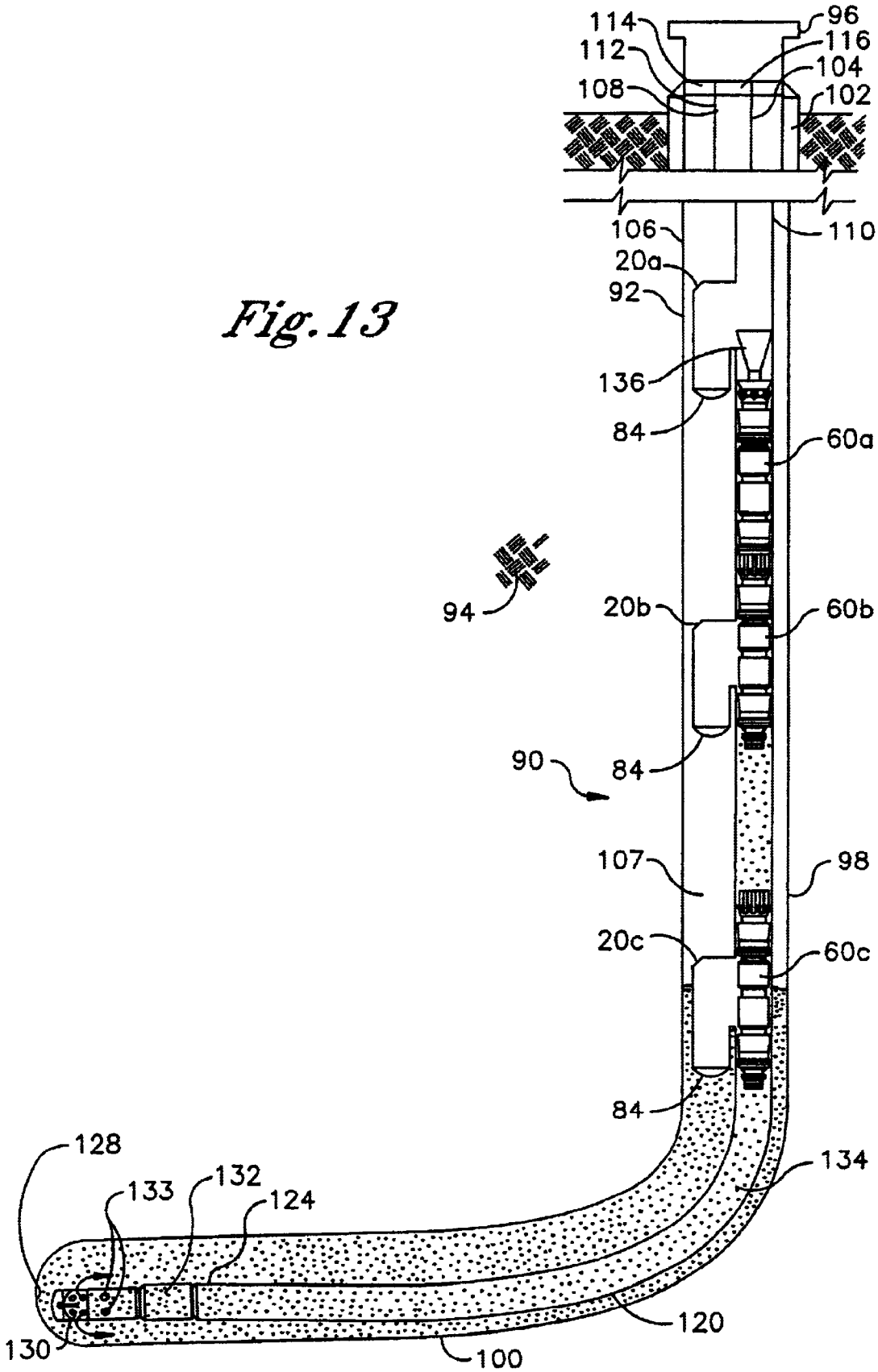

Referring initially to FIG. 11, after the cement slug 134 is placed in the downhole flow path, as shown, a fluid impermeable pump-down plug 136 is positioned in the central opening 116 behind the cement slug 134. Referring to FIG. 12, the pump-down plug 136 is distally displaced through the central opening 116 and riser 10 by a displacement fluid, such as a mud, which is pumped from the well head 96 behind the pump-down plug 136. The pump-down plug 136 is distally displaced by the displacement fluid until it engages the proximal seal 68 of the proximal straddle assembly 60, which is positioned in the inlet leg 22 of the proximal template 20*a*. The pump-down plug 136 is sized to nest in the central aperture 72 of the proximal seal 68, having an outside diameter which approximates the inside diameter of the central aperture 72. As such, the pump-down plug 136 forms a fluid-tight seal between the circumference of the central aperture 72 and the outer periphery of the pump-down plug 136 which closes off the central aperture 72 to fluid flow. The displacement fluid is pumped through the downhole flow path behind the pump-down plug 136 at a sufficient pressure to create a positive displacement pressure differential between the proximal side and the distal side of the pump-down plug 136. When the pressure differential exceeds the failure load of the retention pins 76 of the proximal seal 68, the retention pins 76 shear which permits distal displacement of the entire proximal straddle assembly 60*a* ahead of the pump-down plug 136. =Referring to FIG. 13, the proximal straddle assembly 60*a* and the nested pump-down plug 136 are distally displaced through the inlet leg 22 of the proximal template 20*a* until the distal seal 70 of the proximal straddle assembly 60*a* contacts the proximal seal 68 of the first additional straddle assembly 60*b*, which is positioned in the inlet leg 22 of the first additional template 20*b*. As a result, the proximal straddle assembly 60*a* is cleared from the inlet leg 22 of the proximal template 20*a*, enabling fluid communication between the inlet leg 22 and the offset outlet leg 24 of the proximal template 20*a* via the body 21.

Figure 14:
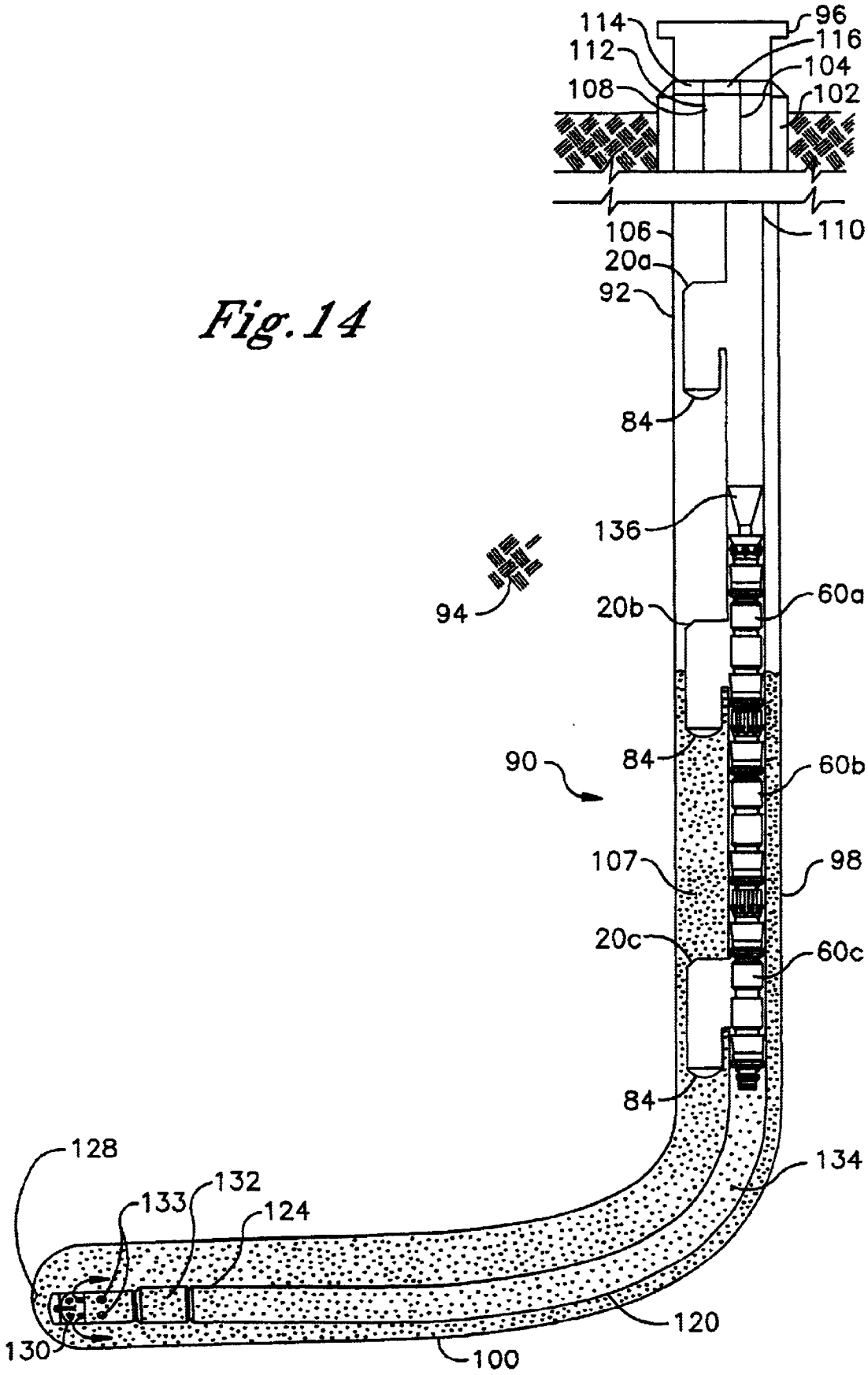

Referring to FIG. 14, the proximal straddle assembly 60*a* and the nested pump-down plug 136 are further distally displaced from the main outlet leg 23 of the proximal template 20*a* into the inlet leg 22 of the first additional template 20*b* by shearing the retention pins 76 of the proximal seal 68 of the first additional straddle assembly 60*b*. As a consequence, the proximal straddle assembly 60*a* displaces the adjoining first additional straddle assembly 60*b* through the inlet leg 22 of the first additional template 20*b* until the distal seal 70 of the first additional straddle assembly 60*b* contacts the proximal seal 68 of the second additional straddle assembly 60*c*, which is positioned in the inlet leg 22 of the second additional template 20*c*. As such, the pump-down plug 136 and straddle assemblies 60*a*, 60*b*, 60*c* are serially stacked in the inlet and main outlet legs 22, 23 of the first and second additional templates 20*b*, 20*c*. It is apparent that each time the displacement fluid displaces a straddle assembly as shown in the preceding FIGS. 13 and 14, the displaced straddle assembly in turn displaces an additional portion of the cement slug 134 from the downhole flow path into the annulus 107.

Figure 15:
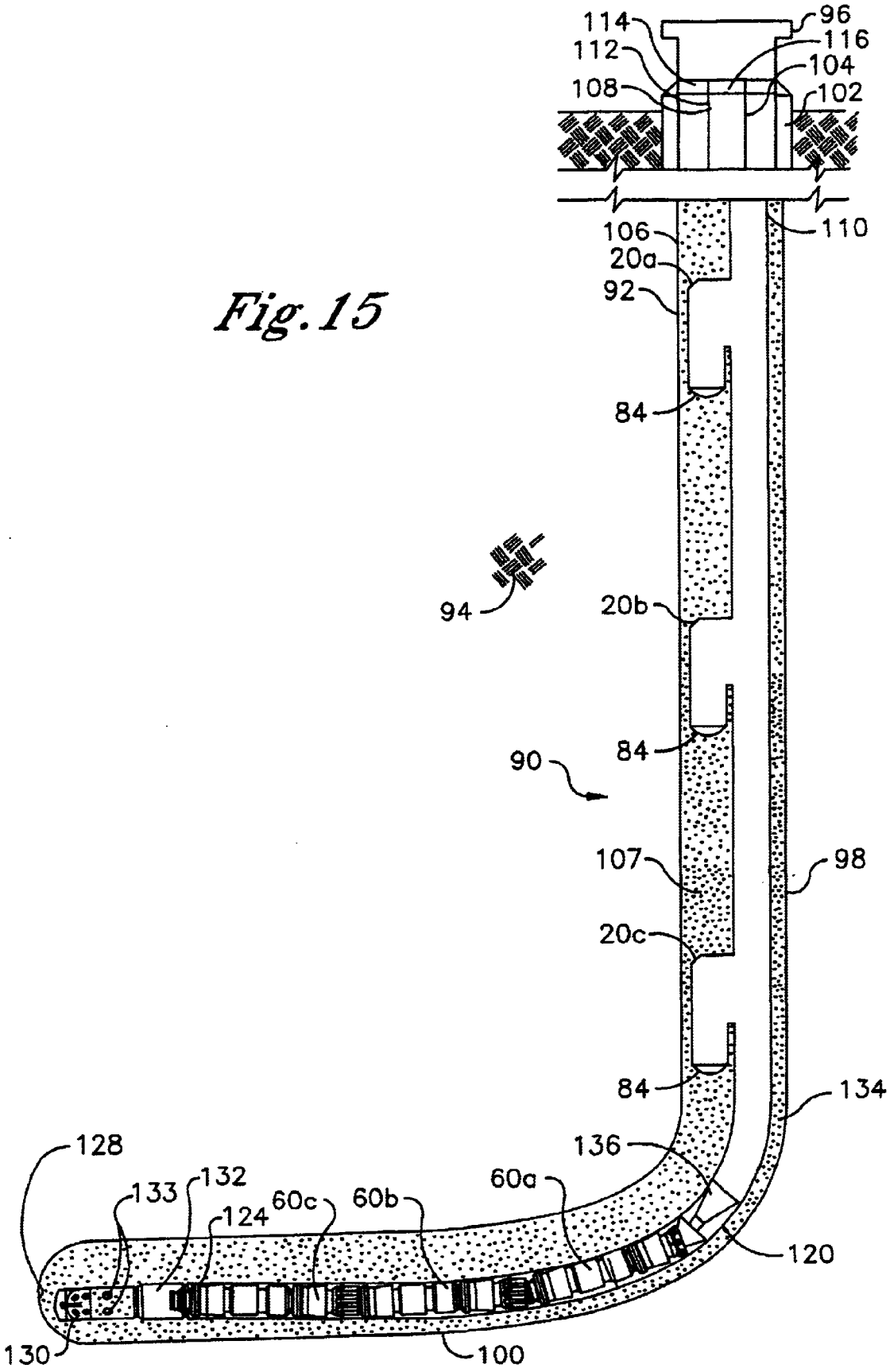

FIG. 15 shows the template system 90 in the final cementing configuration, wherein the proximal straddle assembly 60*a* and nested pump-down plug 136 and the succeeding first and second additional straddle assemblies 60*b*, 60*c* are further distally displaced from the inlet and main outlet legs 22, 23 of the first and second additional templates 20*b*, 20*c* until the pump-down plug 136 and straddle assemblies 60*a*, 60*b*, 60*c* completely clear the templates 20*a*, 20*b*, 20*c*. The serially stacked pump-down plug 136 and straddle assemblies 60*a*, 60*b*, 60*c* are positioned at the landing collar 132 in distal end 124 of the distal extension tube 120. Consequently, the pump-down plug 136 and straddle assemblies 60*a*, 60*b*, 60*c* ensure that the entirety of the cement slug 134 is fully displaced into the annulus 107. Once the cement 134 is properly placed in the annulus 107, it is preferably allowed to set up to complete the cementing process before further operations are performed in or from the main well bore 92. Throughout the cementing process, the straddle assemblies 60*a*, 60*b*, 60*c* and plugs 84 substantially prevent any cement from entering the offset legs 24 of the templates 20*a*, 20*b*, 20*c*. However, upon completion of the cementing process fluid communication is enabled between the respective inlet legs 22 and offset legs 24 of the templates 20*a*, 20*b*, 20*c* via the respective template bodies 21.

Figure 16:
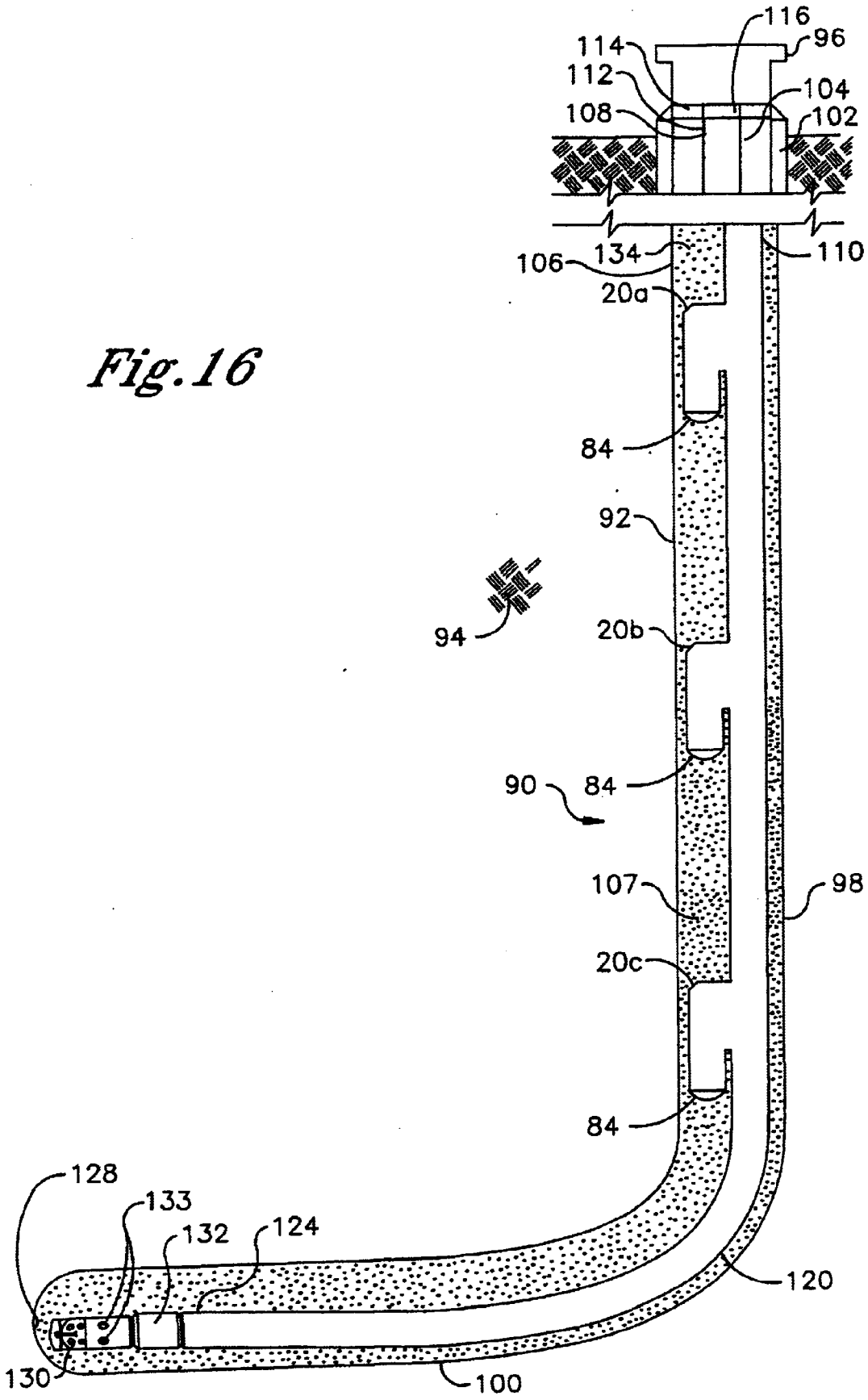
FIG. 16 is a schematic sectional view of a template system of the present invention in a configuration for practicing offset well bore drilling and completion processes.

The template system 90, as shown in FIG. 16, has been reconfigured to an operating configuration which enables processes for drilling and completion of one or more offset well bores from the main well bore 92 using one or more of the cemented templates 20*a*, 20*b*, 20*c* in the template system 90. The configuration shown in FIG. 16 further enables processes for extended drilling and completion of the main well bore 92 beyond the bottom 128. The configuration shown in FIG. 16 differs from the configuration shown in FIG. 15 insofar as the straddle assemblies 60*a*, 60*b*, 60*c* have been removed from the distal extension tube 120 in the configuration of FIG. 16. A preferred means of removing the straddle assemblies 60*a*, 60*b*, 60*c* from the downhole flow path is to drill them out.

The drilling and composition processes of the present invention employ a diverter shown and generally designated 140 in FIG. 17. The diverter 140 comprises a solid cylindrical mandrel 142, a liner packer 144, releasable locking rings 146, and a spring-loaded locking lug 148. The mandrel 142 has a proximal end 150 and a distal end 152. The proximal end 150 has a diagonally slanted face 154 which is slanted at an angle relative to the longitudinal axis of the main well bore 92. The slanted face 154 functions to guide a drilling assembly through the template system 90 in a manner described hereafter. The distal end 152 has a slight taper to facilitate distal displacement of the diverter 140 through the template system 90.

Referring additionally to FIG. 18, the diverter 140 is shown mounted in the body 21 and extending into main outlet leg 23 of the template 20. The slanted face 154 is positioned in the body 21 with the angle of the slanted face 154 aligned toward the offset outlet opening 33. Accordingly, the diverter 140, and more particularly the slanted face 154, directs any fluids, tools or other structures entering the body 21 through the inlet leg 22 into the offset outlet leg 24. The liner packer 144 provides a high-pressure seal between the mandrel 142 and the main outlet leg 23 which substantially prevents any fluids from flowing past the diverter 140 through the main outlet leg 23. The releasable locking rings 146, in cooperation with the grooves 49 shown in FIGS. 1A and 1B, substantially secure the diverter 140 against linear displacement within the template 20 during operation of the diverter 140. Withdrawal of the locking rings 146 from the grooves 49 enables the practitioner to relocate the diverter 140 to another template 20 of the template system 90 as desired. The spring-loaded locking lug 148, in cooperation with the longitudinal slot 50, substantially prevents rotational displacement of the diverter 140 within the template 20 during operation of the diverter 140. The diverter 140 is configured to withstand pressures of at least 3,500 psi, preferably at least 7,000 psi, and more preferably at least 10,000 psi or more without displacement within the main outlet leg 23 while maintaining the seal therewith. Accordingly, the diverter 140 is maintained in place in the template 20 while the template 20 is utilized for drilling or high-pressure completion processes, such as pressure stimulations, described hereafter.

Although not shown, it is apparent to skilled artisan that the diverter 140 can be mounted in the body 21 and alternately extended into the offset outlet leg 24 of the template 20. The slanted face 154 is positioned in the body 21 with the angle of the slanted face 154 aligned toward the main outlet opening 31 to direct any fluids, tools or other structures entering the body 21 through the inlet leg 22 into the main outlet leg 23. Such a configuration has utility for drilling or completion processes which extend the main well bore 92 as noted above.

Figure 19:
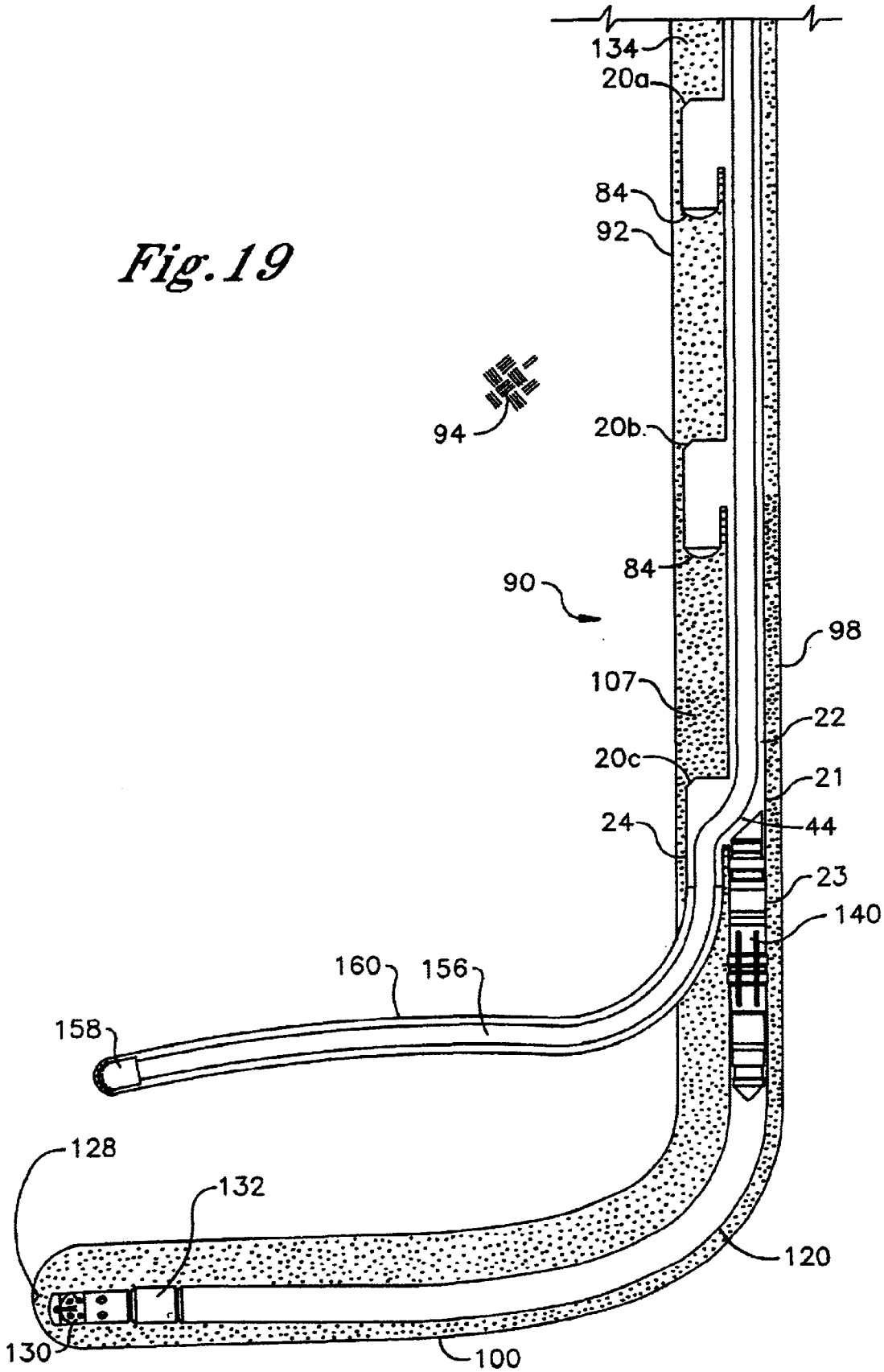
FIGS. 19 and 20 are schematic sectional views of a template system of the present invention in a sequence of operating configurations for practicing the offset well bore drilling and completion processes.

FIG. 19 shows the template system 90 being utilized in an offset well bore drilling process. The diverter 140 is mounted in the second additional template 20*c* in substantially the same manner as described above with reference to FIG. 18. A drill string 156 and distally mounted drill bit 158 are inserted through the main well bore 92 into the template system 90 from a drilling rig at the well head (not shown). The diverter 140 directs the drill string 156 and drill bit 158 as they pass through the proximal opening 32 of the inlet leg 22 of the template 20*c* into the offset outlet leg 24 of the template 20*c* via the junction opening 44. The drill bit 158 is activated to drill through the offset plug 84 in the distal opening 36 of the offset outlet leg 24, the cement slug 134 in the annulus 107, and out through the formation 94 a desired distance to define a first offset well bore 160. The first offset well bore 160 has a longitudinal axis which is at a deviated angle relative to the longitudinal axis of the main well bore 92, or stated alternatively, the longitudinal axis of the first offset well bore 160 is offset from the axis of the main well bore 92.

Figure 20:
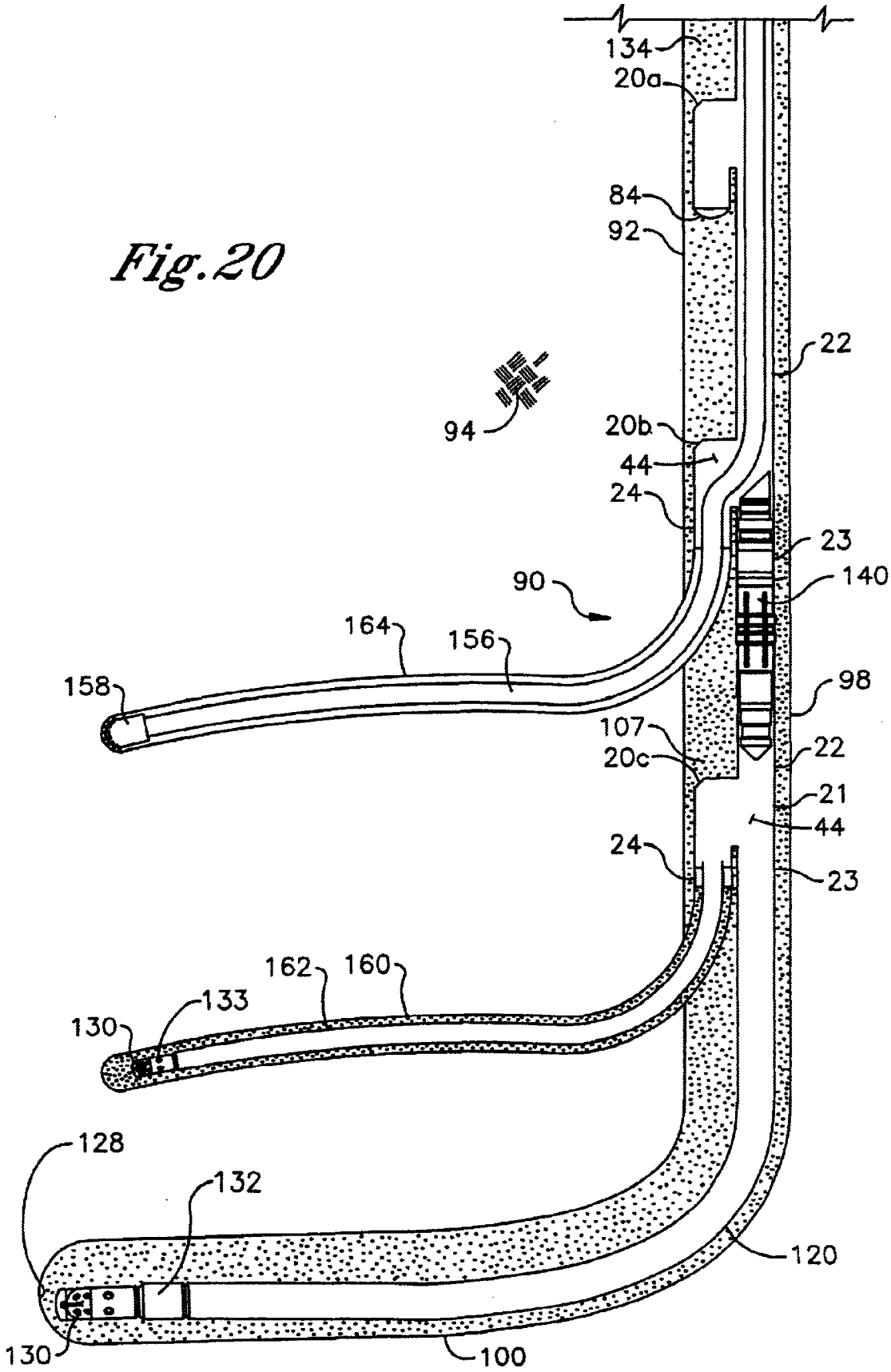

Referring to FIG. 20, the drill string 156 and drill bit 158 are withdrawn from the first offset well bore 160 and a tubing 162, termed a liner, is stabbed into the first offset well bore 160 and hung from the offset outlet leg 24 using a conventional hanger assembly (not shown) mounted in the circular grooves 59. A typical tubing 162 has a diameter of 3½ inches. A set shoe 130 is provided in the tubing 162 which is substantially the same as provided in the distal extension tube 120 as shown in FIG. 10. After cementing the tubing 162 in the first offset well bore 160, the diverter 140 is relocated to the first additional template 20*b* and a second offset well bore 164 is drilled in substantially the same manner as the first offset well bore 160. Although not shown, a tubing 162 is likewise stabbed into the second offset well bore 164 at the conclusion of the process for drilling the second offset well bore 164. After cementing the tubing 162 in the second offset well bore 164, the diverter 140 is relocated to the initial template 20*a* and a third offset well bore 166 is drilled in substantially the same manner as the first offset well bore 160 followed by stabbing and cementing a tubing 162 therein. As noted above, it is further within the scope of the present process to remove the diverter 140 from the main well bore 92 and reinsert a drill string through the distal extension tube 120 for the purpose of distally extending the bottom 128 of the main well bore 92 an additional distance further out into the formation 94.

Figure 21:
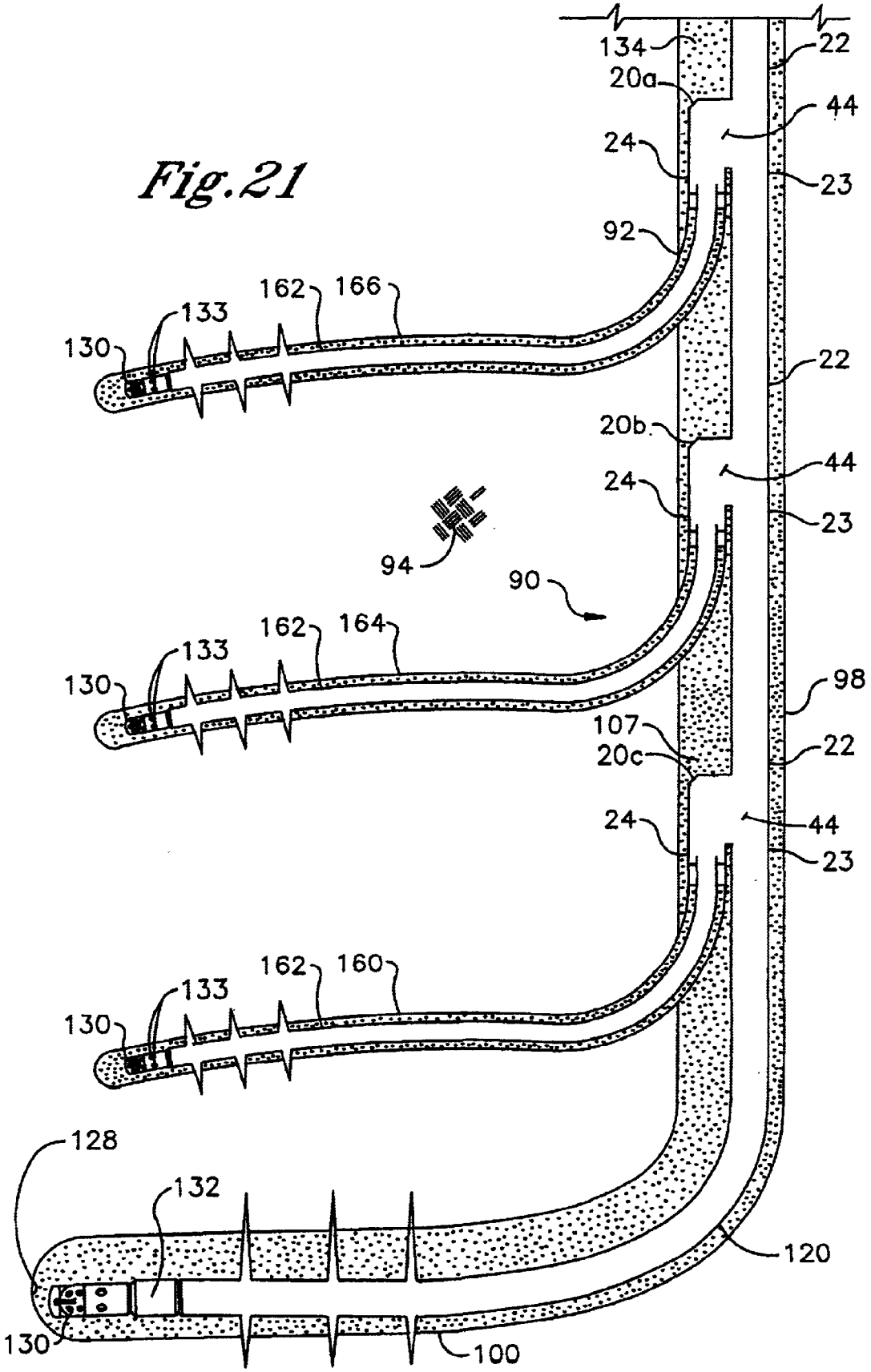
FIG. 21 is a schematic sectional view of a main well bore and a plurality of offset well bores extending therefrom which were drilled and completed using the processes and template system of the present invention.

Referring to FIG. 21, the main well bore 92 is shown having the first, second and third offset well bores 160, 164, 166 drilled therefrom in accordance with the present process. Each of the offset well bores 160, 164, 166 has also been completed as shown by perforating the tubing 162 and optionally pressure stimulating the adjacent formation 94. The main well bore 92 has also been completed by perforating the distal extension tube 120 and optionally pressure stimulating the adjacent formation 94. Completion processes with respect to the offset well bores 160, 164, 166 are performed using the diverter 40 in substantially the same manner as described above with respect to the drilling process to divert tools or tubing strings from the well head which deliver well bore completion fluids into the desired offset well bore. Completion processes with respect to an extension of the main well bore 92 may be performed without the diverter 140 after the offset well bores 160, 164, 166 have been cemented, but before perforation thereof.

Completion fluids are delivered to the extension of the main well bore 92 via the templates 20*a*, 20*b*, 20*c* and the distal extension tube 120.

A specific sequence of performing the offset well bore drilling and completion processes has been described above, wherein the offset well bores 160, 164, 166 are drilled and cemented in a distal to proximal sequence from bottom to top using the single diverter 140 which is likewise relocated from bottom to top to perform each well bore drilling operation in sequence. Thereafter, the offset well bores 160, 164, 166 are completed in a proximal to distal sequence from top to bottom using the single diverter 140 which is likewise relocated from top to bottom to perform each well bore completion operation in sequence.

Although not shown, it is alternatively within the scope of the present invention to employ multiple diverters which are substantially identical to the diverter 140 in the practice of the drilling and completion processes. After the first offset well bore is drilled and cemented using the second additional template and a first diverter, the first diverter is retained in the second additional template and a second diverter is placed in the first additional template. The second offset bore well bore is drilled and cemented using the first additional template and second diverter. The second diverter is retained in the first additional template and a third diverter is placed in the initial template. The third offset bore well bore is drilled and cemented using the initial template and third diverter. Thereafter the third offset well bore is completed using the third diverter and initial template. The third diverter is then removed entirely from the main well bore and the second offset well bore is completed using the second diverter and first additional template. Finally, the second diverter is removed entirely from the main well bore and the first offset well bore is completed using the first diverter and second additional template followed by removal of the first diverter entirely from the main well bore.

It is also within the scope of the present invention to drill the offset well bores 160, 164, 166 in a distal to proximal sequence from bottom to top using the single diverter 140 as described above, but retaining the diverter 140 in place after the first offset well bore 160 is drilled to complete the first offset well bore 160. The newly drilled first offset well bore 160 is completed by delivering the completion fluids directly down the first offset well bore 160 without using a concentric tubing string. The diverter 140 is then proximally relocated for the next well bore drilling operation of the sequence. In this manner, the offset well bores 160, 164, 166 are completed in a distal to proximal sequence which is the same sequence that the offset well bores are drilled.

Although not shown, it is also within the scope of the present invention to maintain the offset well bores 160, 164, 166 uncased and/or uncemented after the offset well bores 160, 164, 166 have been drilled and brought into production. It is also within the scope of the present invention to drill the offset well bores 160, 164, 166 in a proximal to distal sequence and complete the offset well bores 160, 164, 166 in accordance with substantially any of the sequences described above.

While the foregoing preferred embodiments of the invention have been described and shown, it is understood that alternatives and modifications, such as those suggested and others, may be made thereto and fall within the scope of the present invention. For example, a downhole template system can be configured within the scope of the present invention which employs the template 20 in connective series with one or more conventional templates, such as the template disclosed in commonly-owned U.S. Pat. No. 5,330,007, incorporated herein by reference.

We claim:

1. A process for circulating a fluid through a plurality of templates in a main well bore comprising:

providing an initial template and a first additional template, each said initial and first additional templates including a body, a tubular inlet leg, a tubular main outlet leg and a tubular offset outlet leg, said legs opening into said body, serially positioning said initial and first additional templates in a main well bore with said main outlet leg of said initial template connected to said inlet leg of said first additional template;

providing an initial straddle assembly and a first additional straddle assembly, each said initial and first additional straddle assemblies including a straddle tube having proximal and distal ends and proximal and distal seals positioned substantially at said proximal and distal ends;

releasably mounting said initial straddle assembly in said initial template with said proximal seal positioned in said inlet leg and said distal seal positioned in said main outlet leg to provide a continuous straddle assembly flow path through said body and substantially prevent fluid flow from said inlet leg of said initial template into said offset outlet leg of said initial template; and releasably mounting said first additional straddle assembly in said first additional template with said proximal seal positioned in said inlet leg and said distal seal positioned in said main outlet leg to provide a continuous straddle assembly flow path through said body and substantially prevent fluid flow from said inlet leg of said first additional template into said offset outlet leg of said first additional template, such that a continuous downhole flow path is provided through said initial and first additional templates.

2. The process of claim 1 further comprising providing a distal extension tube extending beyond said main outlet leg of said first additional template, said distal extension tube having a proximal end connected to said main outlet leg of said first additional template and having a distal end opening into said main well bore.

3. The process of claim 1 further comprising injecting a fluid distally into said downhole flow path and displacing said fluid proximally into an annulus between a face of said main well bore and said first additional template.

4. The process of claim 3 wherein said fluid is cement.

5. The process of claim 1 further comprising plugging said offset outlet leg of said initial template to prevent fluid communication between said main well bore and said offset outlet leg of said initial template.

6. The process of claim 1 further comprising plugging said offset outlet leg of said first additional template to prevent fluid communication between said main well bore and said offset outlet leg of said first additional template.

7. The process of claim 1 further comprising plugging said initial straddle assembly flow path to substantially prevent pressure communication between a proximal side of said initial straddle assembly and a distal side of said initial straddle assembly.

8. The process of claim 7 further comprising creating a positive pressure differential on said proximal side of said initial straddle assembly to distally displace said initial straddle assembly and enable fluid communication between said inlet leg of said initial template and said offset outlet leg of said initial template.

9. The process of claim 8 further comprising plugging said first additional straddle assembly flow path.

10. The process of claim 9 further comprising creating a positive pressure differential on said proximal side of said initial straddle assembly to distally displace said first additional straddle assembly and enable fluid communication between said inlet leg of said first additional template and said offset outlet leg of said first additional template.

11. The process of claim 1 further comprising distally displacing said initial straddle assembly to enable fluid communication between said inlet leg of said initial template and said offset outlet leg of said initial template.

12. The process of claim 1 further comprising distally displacing said first additional straddle assembly to enable fluid communication between said inlet leg of said first additional template and said offset outlet leg of said first additional template.

13. The process of claim 1 further comprising;

providing second or more additional templates, each said second or more additional templates including said body, said inlet leg, said main outlet leg, and said offset outlet leg, said legs opening into said body;

serially positioning said second or more additional templates with said initial and first additional templates, wherein said main outlet leg of said first additional template is connected to said inlet leg of said second additional template and said main outlet leg of said second additional template is connected to said inlet leg of said next additional template;

providing one second or more additional straddle assemblies for each of said second or more additional templates, each said second or more additional straddle assemblies including a straddle tube having proximal and distal ends and proximal and distal seals positioned substantially at said proximal and distal ends;

releasably mounting said second or more additional straddle assemblies in said second or more additional templates with said proximal seal positioned in said inlet leg and said distal seal positioned in said main outlet leg to provide a continuous straddle assembly flow path through said body of said second or more additional templates and substantially prevent fluid flow from said inlet leg of said second or more additional templates into said offset outlet leg of said second or more additional templates.

14. The process of claim 13 further comprising distally displacing said second or more additional straddle assemblies to enable fluid communication between said inlet leg of said second or more additional templates and said offset outlet leg of said second or more additional templates.

15. The process of claim 1 further comprising drilling an offset well bore by conveying a drill string through said offset outlet leg of said initial template.

16. The process of claim 15 further comprising placing a diverter in said body of said initial template to define a drill string path from said inlet leg to said offset outlet leg of said initial template.

17. The process of claim 16 further comprising pressure stimulating said offset well bore through said offset outlet leg of said initial template.

18. The process of claim 1 further comprising drilling an offset well bore by conveying a drill string through said offset outlet leg of said first additional template.

19. The process of claim 18 further comprising placing a diverter in said body of said first additional template to define a drill string path from said inlet leg into said offset outlet leg of said first additional template.

20. At The process of claim 18 further comprising pressure stimulating said offset well bore through said offset outlet leg of said first additional template.

21. A process for circulating a fluid through a template in a main well bore comprising:

providing a template including a body, a tubular inlet leg, a tubular main outlet leg and a tubular offset outlet leg, said legs opening into said body;

positioning said template in a main well bore to form an annulus between said template and a face of said main well bore;

providing a straddle assembly including a straddle tube having proximal and distal ends and proximal and distal seals positioned substantially at said proximal and distal ends; and releasably mounting said straddle assembly in said template with said proximal seal positioned in said inlet leg and said distal seal positioned in said main outlet leg to provide a continuous straddle assembly flow path through said body and substantially prevent fluid flow from said inlet leg and from said main outlet leg into said offset outlet leg, such that a continuous downhole flow path is provided through said inlet leg, said straddle assembly, and said main outlet leg.

22. The process of claim 21 further comprising plugging said offset outlet leg to prevent fluid communication between said main well bore and said offset outlet leg.

23. The process of claim 21 further comprising injecting a fluid distally into said downhole flow path and displacing said fluid proximally into said annulus.

24. The process of claim 23 further comprising providing at least one by-pass tube through said template and proximally displacing said fluid through said at least one by-pass tube past said template.

25. The process of claim 23 wherein said fluid is cement, said process further comprising setting up said cement in said annulus.

26. The process of claim 21 further comprising distally displacing said straddle assembly to enable fluid communication between said inlet leg and said offset outlet leg.

27. The process of claim 21 further comprising drilling an offset well bore through said offset outlet leg.

28. The process of claim 27 further comprising completing said offset well bore through said offset outlet leg.

29. The process of claim 21 further comprising extending said main well bore by conveying a drill string through said main outlet leg.

30. In a process for injecting a fluid into a well bore extending downward from an earthen surface and penetrating a subterranean hydrocarbon-bearing formation, the improvement comprising:

providing a template including an inlet leg, a main outlet leg and an offset outlet leg, wherein said inlet leg and said main outlet leg contain a continuous downhole flow path therethrough;

positioning said template in said well bore to form an annulus between said template and a face of said well bore;

distally injecting said fluid away from said earthen surface through said downhole flow path and into said annulus;

proximally displacing a first portion of said injected fluid toward said earthen surface through said annulus past said template; and providing at least one by-pass tube through said template and proximally displacing a second portion of said injected fluid toward said earthen surface through said at least one by-pass tube past said template.

31. The process of claim 30 further comprising plugging said offset outlet leg.

32. The process of claim 30 wherein said template includes a body, said legs opening into said body, further wherein said body has a substantially cylindrical cross section.

33. The process of claim 30 wherein said fluid is displaced past said template at a pressure greater than about 3500 psi.

34. A process for circulating a fluid through a template in a main well bore comprising:

providing a template including a body, a tubular inlet leg, a tubular main outlet leg and a tubular offset outlet leg, said legs opening into said body;

positioning said template in a main well bore to form an annulus between said template and a face of said main well bore;

providing a straddle assembly including a straddle tube having proximal and distal ends and proximal and distal seals positioned substantially at said proximal and distal ends;

releasably mounting said straddle assembly in said template with said proximal seal positioned in said inlet leg and said distal seal positioned in said main outlet leg to provide a continuous straddle assembly flow path through said body and substantially prevent fluid flow from said inlet leg into said offset outlet leg, such that a continuous downhole flow path is provided through said inlet leg, said straddle assembly, and said main outlet leg; and injecting a cement distally into said downhole flow path and displacing said cement proximally into said annulus.

35. The process of claim 34 further comprising setting up said cement in said annulus.

36. A process for circulating a fluid through a template in a main well bore comprising:

providing a template including a body, a tubular inlet leg, a tubular main outlet leg and a tubular offset outlet leg, said legs opening into said body;

positioning said template in a main well bore to form an annulus between said template and a face of said main well bore;

providing a straddle assembly including a straddle tube having proximal and distal ends and proximal and distal seals positioned substantially at said proximal and distal ends;

releasably mounting said straddle assembly in said template with said proximal seal positioned in said inlet leg and said distal seal positioned in said main outlet leg to provide a continuous straddle assembly flow path through said body and substantially prevent fluid flow from said inlet leg into said offset outlet leg, such that a continuous downhole flow path is provided through said inlet leg, said straddle assembly, and said main outlet leg; and drilling an offset well bore through said offset outlet leg.

37. The process of claim 36 further comprising completing said offset well bore through said offset outlet leg.

38. A process for circulating a fluid through a template in a main well bore comprising:

providing a template including a body, a tubular inlet leg,a tubular main outlet leg and a tubular offset outlet leg, said legs opening into said body;

positioning said template in a main well bore to form an annulus between said template and a face of said main well bore;

providing a straddle assembly including a straddle tube having proximal and distal ends and proximal and distal seals positioned substantially at said proximal and distal ends;

releasably mounting said straddle assembly in said template with said proximal seal positioned in said inlet leg and said distal seal positioned in said main outlet leg to provide a continuous straddle assembly flow path through said body and substantially prevent fluid flow from said inlet leg into said offset outlet leg, such that a continuous downhole flow path is provided through said inlet leg, said straddle assembly, and said main outlet leg; and extending said main well bore by conveying a drill string through said main outlet leg.

39. A process for circulating a fluid through a template in a main well bore comprising:

providing a template including a body, a tubular inlet leg, a tubular main outlet leg and a tubular offset outlet leg, said legs opening into said body;

positioning said template in a main well bore to form an annulus between said template and a face of said main well bore;

providing a straddle assembly including a straddle tube having proximal and distal ends;

mounting said straddle assembly in said template with said proximal end positioned in said inlet leg and said distal end positioned in said main outlet leg to provide a continuous straddle assembly flow path through said body and a continuous downhole flow path through said inlet leg, said straddle assembly, and said main outlet leg; and injecting a fluid distally into said downhole flow path and displacing said fluid proximally into said annulus, while maintaining said offset outlet leg in fluid isolation from said fluid.

40. The process of claim 39 further comprising providing at least one by-pass tube through said template and proximally displacing said fluid through said at least one by-pass tube past said template.

41. The process of claim 39 wherein said fluid is cement, said process further comprising setting up said cement in said annulus.

42. The process of claim 39 further comprising distally displacing said straddle assembly to enable fluid communication between said inlet leg and said offset outlet leg.

43. The process of claim 39 further comprising drilling an offset well bore through said offset outlet leg.

44. The process of claim 43 further comprising completing said offset well bore through said offset outlet leg.

45. The process of claim 39 further comprising extending said main well bore by conveying a drill string through said main outlet leg.

46. A process for circulating a fluid through a template in a main well bore comprising:

providing a template including a body, a tubular inlet leg, a tubular main outlet leg and a tubular offset outlet leg, said legs opening into said body;

positioning said template in a main well bore to form an annulus between said template and a face of said main well bore;

providing a straddle assembly including a straddle tube having proximal and distal ends and proximal and distal seals positioned substantially at said proximal and distal ends;

mounting said straddle assembly in said template with said proximal seal positioned in said inlet leg and said distal seal positioned in said main outlet leg to provide a continuous straddle assembly flow path through said body and substantially prevent fluid flow from said inlet leg into said offset outlet leg, such that a continuous downhole flow path is provided through said inlet leg, said straddle assembly, and said main outlet leg;

injecting a cement distally into said downhole flow path; and opening said offset outlet lea to communication with said inlet leg.

47. The process of claim 46 further comprising setting up said cement in said annulus.

48. A process for circulating a fluid through a template in a main well bore comprising:

providing a template including a body, a tubular inlet leg, a tubular main outlet leg and a tubular offset outlet leg, said legs opening into said body;

positioning said template in a main well bore to form an annulus between said template and a face of said main well bore;

providing a straddle assembly including a straddle tube having proximal and distal ends and proximal and distal seals positioned substantially at said proximal and distal ends;

mounting said straddle assembly in said template with said proximal seal positioned in said inlet leg and said distal seal positioned in said main outlet leg to provide a continuous straddle assembly flow path through said body and substantially prevent fluid flow from said inlet leg into said offset outlet leg, such that a continuous downhole flow path is provided through said inlet leg, said straddle assembly, and said main outlet leg;

opening said offset outlet leg to communication with said inlet leg; and drilling an offset well bore through said offset outlet leg.

49. The process of claim 48 further comprising injecting a cement distally into said downhole flow path before opening said offset outlet leg to communication with said inlet leg.

50. The process of claim 48 further comprising completing said offset well bore through said offset outlet leg.

51. A process for circulating a fluid through a template in a main well bore comprising:

providing a template including a body, a tubular inlet leg, a tubular main outlet leg and a tubular offset outlet leg, said legs opening into said body;

positioning said template in a main well bore to form an annulus between said template and a face of said main well bore;

providing a straddle assembly including a straddle tube having proximal and distal ends and proximal and distal seals positioned substantially at said proximal and distal ends;

releasably mounting said straddle assembly in said template with said proximal seal positioned in said inlet leg and said distal seal positioned in said main outlet leg to provide a continuous straddle assembly flow path through said body and substantially prevent fluid flow from said inlet leg into said offset outlet leg, such that a continuous downhole flow path is provided through said inlet leg, said straddle assembly, and said main outlet leg;

opening said offset outlet leg to communication with said inlet leg; and extending said main well bore by conveying a drill string through said main outlet leg.

52. The process of claim 51 further comprising injecting a cement distally into said downhole flow path before opening said offset outlet leg to communication with said inlet leg.

* * * * *